US009187154B2

(12) United States Patent
Hansen

(10) Patent No.: US 9,187,154 B2
(45) Date of Patent: Nov. 17, 2015

(54) RFID TAG READING SYSTEMS AND METHODS FOR AQUATIC TIMED EVENTS

(71) Applicant: Innovative Timing Systems, LLC, St. Louis, MO (US)

(72) Inventor: Kurt S. Hansen, Chesterfield, MO (US)

(73) Assignee: Innovative Timing Systems, LLC, St. Louis, MO (US)

( * ) Notice: Subject to any disclaimer, the term of this patent is extended or adjusted under 35 U.S.C. 154(b) by 259 days.

(21) Appl. No.: 13/957,336

(22) Filed: Aug. 1, 2013

(65) Prior Publication Data

US 2014/0035729 A1 Feb. 6, 2014

Related U.S. Application Data

(60) Provisional application No. 61/678,291, filed on Aug. 1, 2012.

(51) Int. Cl.
*B63B 22/16* (2006.01)
*B63B 22/04* (2006.01)
(Continued)

(52) U.S. Cl.
CPC ..... *B63B 22/16* (2013.01); *B63B 22/04* (2013.01); *B63B 22/20* (2013.01); *G07C 1/24* (2013.01)

(58) Field of Classification Search
CPC ..... B63B 22/16; B63B 22/04; B63B 22/20; G07C 1/24; A63B 24/0021; A63B 24/0075; A63B 69/0028; A63F 13/10; A63F 2300/6676; A63F 2300/69; A63F 2300/8082; B63C 11/12; B63C 2011/121; G06T 19/00; H04N 13/044
USPC ..... 340/10.1, 10.2, 10.3, 10.31, 10.32, 340/10.33, 10.34, 10.4, 10.41, 10.42, 10.5, 340/10.51, 10.52; 441/1; 345/419, 8, 156, 345/549, 584; 706/46; 715/810; 707/E17.019, E17.018, E17.016
See application file for complete search history.

(56) References Cited

U.S. PATENT DOCUMENTS 3,386,407 A * 6/1968 Mount ..... 114/293
3,674,225 A * 7/1972 Johnson ..... 244/31
3,965,512 A * 6/1976 Bennett et al. ..... 441/25
(Continued)

FOREIGN PATENT DOCUMENTS

EP 2009595 A 12/2008
JP 2003-327331 A 11/2003
(Continued)

OTHER PUBLICATIONS

PCT Search Report, PCT US 2012-022132, Sep. 14, 2012.
PCT Search Report, PCT US 2011-026717, Mar. 1, 2011.
Electronic Product Code (EPC) Tag Data Standards Version 1.1 Rev. 1.24; EPC Global, Inc. Apr. 1, 2004.
Integration of RFID and Cellular Technologies, UCLA, WINMEC 2004; Karali, Sep. 2004.
Alien Debuts Gen 2 Interrogator, RFID Journal; O'Connor, Aug. 4, 2005.
PCT Search Report, PCT US 2012-022125, Jan. 20, 2012.
(Continued)

*Primary Examiner* — Jennifer Mehmood
*Assistant Examiner* — Yong Hang Jiang
(74) *Attorney, Agent, or Firm* — Polster Lieder

(57) ABSTRACT

A system and method for determining the passing of a participant of an aquatic event by a water-based timing point including an RFID tag associated with the participant, an aquatic based RFID tag reading point having one or more aquatic tag reading assemblies placed in the water, each aquatic tag reading assembly having one or more RFID tag readers mounted thereon at a position above the surface of the water on an aquatic tag reader mounting assembly, the aquatic tag reader mounting assembly having a portion below the surface of the water and including at least one float system and at least one stabilization system.

25 Claims, 12 Drawing Sheets

(51) Int. Cl.

| | |
|---|---|
| ***B63B 22/20*** | (2006.01) |
| ***G07C 1/24*** | (2006.01) |

(56) References Cited

U.S. PATENT DOCUMENTS

| | | | |
|---|---|---|---|
| 4,142,680 | A | 3/1979 | Oswald et al. |
| 4,505,595 | A | 3/1985 | Rose et al. |
| 4,812,845 | A | 3/1989 | Yamada et al. |
| 4,918,630 | A | 4/1990 | Plouff et al. |
| 5,091,895 | A | 2/1992 | Chatwin et al. |
| 5,140,307 | A | 8/1992 | Rebetez et al. |
| 5,436,611 | A | 7/1995 | Arlinghaus, Jr. |
| 5,493,805 | A | 2/1996 | Penuela et al. |
| 5,511,045 | A | 4/1996 | Sasaki et al. |
| 5,604,485 | A | 2/1997 | Lauro et al. |
| 5,696,481 | A | 12/1997 | Pejas et al. |
| 5,812,049 | A | 9/1998 | Uzi |
| 5,821,902 | A | 10/1998 | Keen |
| 5,883,582 | A | 3/1999 | Bowers et al. |
| 5,973,598 | A | 10/1999 | Beigel |
| 6,008,773 | A | 12/1999 | Matsuoka et al. |
| 6,100,804 | A | 8/2000 | Brady et al. |
| 6,204,813 | B1 | 3/2001 | Wadell et al. |
| 6,278,413 | B1 | 8/2001 | Hugh et al. |
| 6,340,932 | B1 | 1/2002 | Rodgers et al. |
| 6,369,697 | B1 | 4/2002 | Poole |
| 6,466,178 | B1 | 10/2002 | Muterspaugh |
| 6,496,806 | B1 | 12/2002 | Horwitz et al. |
| 6,512,478 | B1 | 1/2003 | Chien |
| 6,570,487 | B1 | 5/2003 | Steeves |
| 6,577,238 | B1 | 6/2003 | Whitesmith et al. |
| 6,696,954 | B2 | 2/2004 | Chung |
| 6,703,935 | B1 | 3/2004 | Chung et al. |
| 6,710,713 | B1 | 3/2004 | Russo |
| 6,720,930 | B2 | 4/2004 | Johnson et al. |
| 6,812,824 | B1 | 11/2004 | Goldinger et al. |
| 6,839,027 | B2 | 1/2005 | Krumm et al. |
| 6,888,459 | B2 | 5/2005 | Stilp |
| 6,888,502 | B2 | 5/2005 | Beigel et al. |
| 6,952,157 | B1 | 10/2005 | Stewart et al. |
| 6,963,270 | B1 | 11/2005 | Gallagher, III et al. |
| 6,989,750 | B2 | 1/2006 | Shanks et al. |
| 6,995,655 | B2 | 2/2006 | Ertin et al. |
| 7,009,562 | B2 | 3/2006 | Jenabi |
| 7,019,639 | B2 | 3/2006 | Stilp |
| 7,057,511 | B2 | 6/2006 | Shanks et al. |
| 7,057,975 | B2 | 6/2006 | Stobbe |
| 7,339,478 | B2 | 3/2008 | Le |
| 7,508,739 | B2 | 3/2009 | Paes |
| 7,589,616 | B2 | 9/2009 | Klatsmanyi et al. |
| 7,605,685 | B2 | 10/2009 | Stewart et al. |
| 7,605,689 | B2 | 10/2009 | Hein et al. |
| 8,085,136 | B2 | 12/2011 | Stewart et al. |
| 8,179,233 | B2 | 5/2012 | Kia |
| 2001/0040895 | A1 | 11/2001 | Templin |
| 2002/0008622 | A1 | 1/2002 | Weston et al. |
| 2002/0008624 | A1 | 1/2002 | Paek |
| 2002/0044057 | A1 | 4/2002 | Zirbes |
| 2002/0044096 | A1 | 4/2002 | Chung |
| 2003/0014678 | A1 | 1/2003 | Ozcetin et al. |
| 2003/0073518 | A1 | 4/2003 | Marty et al. |
| 2003/0163287 | A1 | 8/2003 | Vock et al. |
| 2003/0189484 | A1* | 10/2003 | Rust et al. ..... 340/323 R |
| 2004/0006445 | A1 | 1/2004 | Paek |
| 2005/0093976 | A1 | 5/2005 | Valleriano et al. |
| 2005/0099269 | A1 | 5/2005 | Diorio et al. |
| 2006/0097847 | A1 | 5/2006 | Bervoets et al. |
| 2006/0097874 | A1 | 5/2006 | Salesky et al. |
| 2006/0176216 | A1 | 8/2006 | Hipskind |
| 2007/0076528 | A1 | 4/2007 | Kirby |
| 2007/0097969 | A1 | 5/2007 | Regnier |
| 2007/0182567 | A1 | 8/2007 | Stewart et al. |
| 2007/0252770 | A1 | 11/2007 | Kai et al. |
| 2007/0262871 | A1 | 11/2007 | Yamagajo et al. |
| 2007/0272011 | A1 | 11/2007 | Chapa, Jr. et al. |
| 2008/0021676 | A1 | 1/2008 | Vock et al. |
| 2008/0139263 | A1 | 6/2008 | He et al. |
| 2008/0143620 | A1 | 6/2008 | Khatri |
| 2008/0246615 | A1 | 10/2008 | Duron et al. |
| 2008/0246616 | A1 | 10/2008 | Sakama et al. |
| 2008/0316032 | A1 | 12/2008 | Kia |
| 2009/0015377 | A1 | 1/2009 | Fogg et al. |
| 2009/0184806 | A1 | 7/2009 | Kia |
| 2009/0231198 | A1 | 9/2009 | Walsh et al. |
| 2009/0284368 | A1 | 11/2009 | Case, Jr. |
| 2010/0019897 | A1 | 1/2010 | Stewart et al. |
| 2010/0088023 | A1 | 4/2010 | Werner |
| 2010/0271263 | A1 | 10/2010 | Moshfeghi |
| 2010/0295943 | A1 | 11/2010 | Cha et al. |
| 2010/0302910 | A1 | 12/2010 | Howell |
| 2011/0054792 | A1 | 3/2011 | McClellan |
| 2011/0141221 | A1 | 6/2011 | Satterlee et al. |
| 2011/0298583 | A1 | 12/2011 | Libby et al. |
| 2012/0115557 | A1 | 5/2012 | Kia |
| 2012/0230240 | A1 | 9/2012 | Nebat et al. |
| 2014/0052279 | A1 | 2/2014 | Van Rens |

FOREIGN PATENT DOCUMENTS

| | | | |
|---|---|---|---|
| JP | 2006-053655 | A | 2/2006 |
| JP | 2008-276353 | A | 11/2006 |
| JP | 2008-299535 | A | 12/2008 |
| JP | 4394600 | A | 10/2009 |
| JP | 2010-088886 | A | 4/2010 |
| KR | 10-2002-0008234 | A | 1/2002 |
| KR | 10-2002-0065429 | A | 8/2002 |
| KR | 10-0438359 | B1 | 7/2004 |
| KR | 10-2010-0100500 | A | 9/2010 |
| KR | 10-2010-0119271 | A | 11/2010 |

OTHER PUBLICATIONS

Electronic Product Code (EPC) Radio-Frequency Indentity Protocols Class-1 Generation-2 UHF FRID Protocol for Communications at 860 MHz-960 Mhz, Version 1.0.9; EPC Global, Inc., Jan. 2005.
Electronic Product Code (EPC) Generation 1 Tag Data Standards Version 1.1 Rev.1.27; EPC Global, Inc., May 10, 2005.
UHF Gen 2 System Overview, TI-RFID; Texas Instruments, Mar. 2005.
Trolleyponder/Ecotag RFID Newsletter, No. 51; Trolley Scan Pty Ltd, Jan. 5, 2006.
Tests on Timing Module for Sports Timing; Trolley Scan Pty, Jun. 2004.
New for 2005—Best Racing now uses DAG chip timing; DAG 2005.
Intermec RFID System Manual; Intermec 2005.
RFID Primer; Alien Technology, 2004.
DAG System Instructions, Version 4; Pygma Lyon (DAG), Jul. 9, 2004.
DAG System Instructions—DAG Triathlon, Version 5; Pygma Lyon (DAG) Jul. 23, 2004.
DAG System—Badgeur V2 Sport Version Datasheet; Pygma Lyon (DAG), Jul. 19, 2004.
Alien RFID Academy Training Manual; Alien Technology, Sep. 22, 2004.
Alien Advanced RFID Academy; Alien Technology, Mar. 16, 2005.
Reader Interface Guide, V2.1.0; Alien Technology, 2004.
Mobile RFID Reader with Database Wireless Synchronization, S. Sandoval-Reyes, et al, 2nd ICEEE and CIE2005, Mexico City, Sep. 7-9, 2005.
PCT Search Report, PCT US 2012-022126, Jan. 20, 2012.
Mitigating the Reader Collision Problem in RFID Networks with Mobile Readers, Shailesh M. Birair and Sridhar Iyer, Indian Institute of Technology, Mumbai, India, 400 076, IEEE, 2005.
PCT Search Report, PCT US 2011-020901, Jan. 11, 2011.
PCT Search Report, PCT US 2011-020905, Jan. 11, 2011.
PCT Search Report, PCT US 2011-046032, Jul. 29, 2011.
PCT Search Report, PCT US 2011-050570, Sep. 6, 2011.

* cited by examiner

RFID TAG READING SYSTEMS AND METHODS FOR AQUATIC TIMED EVENTS

CROSS-REFERENCE TO RELATED APPLICATIONS

This application claims the benefit of U.S. Provisional Application No. 61/678,291, filed on Aug. 1, 2012. The disclosure of the above application is incorporated herein by reference.

FIELD

The present disclosure relates to timing systems and more specifically, to a timing system for timing aquatic events.

BACKGROUND

The statements in this section merely provide background information related to the present disclosure and may not constitute prior art.

There are numerous events held with participants in water many of which are timed events. These include swimming races, surfboarding, and powered equipment events. Often the participants in these events are positioned in the water and are required to traverse a course or path in the water, or travel between two or more points or demarcation lines that are partially or wholly in the water. When timing many sporting events, such a running and biking events, it has become very common to use passive RFID tags for identifying the participant and the proximity of the participant to a monitored demarcation line or milestone such as a starting line, split point, turning point or finish line, by way of example. In such systems, the RFID tags are placed on a participant, on their clothing or a bib, or on the participant's vehicle for uniquely identifying the participant and for identifying the passing of the participant at the monitored point. For land based events, the RFID tag readers can easily be placed on a surface along the road or path for such sporting events even where there are numerous participants making a passing such as during a marathon race. For example, at a start of a marathon race, nearly all of the participants pass the starting line within a very short period of time. In such situations, one or more RFID tag readers with one or more RF antennas are placed at that starting line or are multiple points relative to the starting line to ensure that all participants' tags are read and the timing system logs their passing and the time of their individual passing.

However, for aquatic events, RFID tags and RFID tag readers have not been used with success. This is due to the RF absorption qualities of water, the position of the passive RFID tag on the participant or participant vehicle that may be at or near or under the surface of the water, or which may be immersed or covered with water at the time of the passing of the participant at a timed point at which the RFID tag reader is attempting to read the RFID tag of the participant. Additionally, the timing point readers would often be required to be placed in the water at the water located timing point. Due to these factors, the use of RFID tags and RFID tag readers for timed event systems has been extremely limited and often not used. Further, where attempted, it has been found to be very difficult to nearly impossible to stabilize the RF tag readers and their antennas in the water so as to consistently perform RF tag reads to the water located RFID tags that are approaching and passing the timing point. This is particularly true where there have been numerous to large number of RFID tags to be read that often requires sufficient advancing distances so as to not interfere with the participants and that provide for the desired accuracy of tag reads such that nearly all if not all participant tags are read and there are no missed tags. Further, the surface positioning of the RFID tag readers and in particular their RFID antenna are often moving due to changes in the surface and water flow conditions of the water, such as waves that may be due to displacement of the water by the participants or other sources including the wind and the tide.

SUMMARY

The inventor hereof has identified these problems and limitations but also the desirability of using RFID tags and RFID tag readers and timing systems for aquatic events and invented a novel and nonobvious improvement to RFID tag readers and timing systems for effective use in aquatic located timing points for timed events. As developed by the inventor hereof, a new aquatic RFID tag reading system and method provides for significant improvements in the performance of water located RFID tag readings for timed events having one or more or all of the monitored timing points being located in the body of water, aquatic timing points. The presently disclosed system provides for consistent and accurate reading of passing RFID tags of participants or their vehicles. This includes, and is not limited to, systems and methods for determining the passing of a participant of an aquatic event by a water-based or aquatic timing point including an RFID tag associated with the participant, an aquatic based RFID tag reader system having one or more aquatic positioned RFID antenna assemblies placed in one or more aquatic positions.

Each aquatic RFID antenna mounting assembly can have one or more RFID antenna mounted thereon at a position above the surface of the water and positioned to define one or more RF based timing lanes as virtual lanes within the body of water. Each aquatic RFID antenna mounting assembly and the antennas mounted thereon is coupled to one or more aquatic RFID tag readers located either on a RFID tag reader mounting platform, or on land. The aquatic RFID antenna mounting assembly has a portion that can be a substantial portion that is below the surface of the water and can include at least one floatation device and at least one stabilization device for anchoring to the bottom of the body of water.

In one aspect, an assembly for use with an event timing system for determining a timing of passing of an aquatic timing point by a participant participating in a timed aquatic event, the participant has an RFID tag with a unique participant identifier. The participant can be a person, a boat, a vehicle or any other water based device. The system includes an elongated body having an upper end and a lower end, and a middle portion positioned between the upper end and the lower end. An RFID antenna mounting assembly is attached proximate to the upper end of the elongated body configured for mounting an RFID antenna. A stabilizer assembly is located at a fixed vertical position of the middle portion of the elongated body and includes a plurality of radially spaced apart coupling connectors. A plurality of anchors with each anchor having a mass significantly greater than water is configured for placement on a bottom of an aquatic body. Each anchor includes a coupling fixture. A plurality of anchor lines is provided having first ends for attachment to one of the coupling connectors of the stabilizer assembly and second ends for attachment to the coupling fixture of one of the anchors. One or more floatation devices are coupled to at least one of the elongated body and the stabilizer assembly. The floatation devices are selected, configured and/or dimensioned to have a sum of a buoyancy to provide substantial floatation of the elongated body and the stabilizer assembly following mounting of an antenna to the RFID antenna mounting assembly.

In another aspect, a system is provided for recording a passing of a participant participating in a timed aquatic event past an aquatic timing point with the participant having an RFID tag with a unique participant identifier. The system includes an RFID tag reader system having a processor, a memory, a clock, a communication interface, a radio frequency transceiver for generating a wireless communication with the RFID tag via an antenna. An aquatic antenna mounting assembly has an elongated body with an upper end and a lower end, and a middle portion positioned between the upper end and the lower end. An RFID antenna mounting assembly is attached proximate to the upper end of the elongated body for mounting an RFID antenna. The aquatic mounting assembly includes a stabilizer assembly located at a fixed vertical position of the middle portion of the elongated body and a plurality of radially spaced apart coupling connectors. The aquatic mounting assembly also includes a plurality of anchors, each anchor having a mass significantly greater than water for placement on a bottom of an aquatic body and each having a coupling fixture. A plurality of anchor lines is provided with each anchor line having a first end for attachment to one of the coupling connectors of the stabilizer assembly and a second end for attachment to the coupling fixture of one of the anchors. The assembly includes one or more floatation devices coupled to at least one of the elongated body and the stabilizer assembly. The flotation devices are configured and or selected so that the sum of their buoyancy provides a substantial floatation of the elongated body and the stabilizer assembly following mounting of an antenna to the RFID antenna mounting assembly. The aquatic antenna mounting assembly is positionable proximate to the aquatic timing point. The system also includes an RFID antenna mounted on the RFID antenna mounting assembly. The antenna is communicatively coupled to the radio frequency transceiver of the RFID tag reader system. The RFID tag reader system is configured for transmitting a tag read request from the antenna to the RFID tag of the participant and for receiving at the antenna one or more tag reads from the RFID tag, and then transmitting the tag read request and the tag reads between the RFID tag reader system and the antenna.

In yet another aspect, a system is provided for timing a plurality of participants participating in a timed aquatic event as they travel past at least one aquatic timing point, each participant having an RFID tag with a unique participant identifier. The system includes an event timing system having a processor for executing computer executable instructions, a memory for storing the computer executable instructions, and a communication interface. The event timing system is configured for receiving over the communication interface a plurality of RFID tag reads for each participant, determining a time for each tag read, and determining a lapse time of each participant in the timed aquatic event as a function of the plurality of RFID tag reads. The system also includes an RFID tag reader system having a processor, a memory, a clock, a communication interface for communicating with the event timing system and transmitting RFID tag reads as determined by the RFID tag read system to the even timing system. The RFID tag reader system has a radio frequency transceiver for generating a wireless communication with the RFID tag via an antenna. An aquatic antenna mounting assembly has an elongated body with an upper end and a lower end, and a middle portion positioned between the upper end and the lower end. An RFID antenna mounting assembly is attached proximate to the upper end of the elongated body configured for mounting an RFID antenna. A stabilizer assembly is located at a fixed vertical position of the middle portion of the elongated body and includes a plurality of radially spaced apart coupling connectors. It also includes a plurality of anchors with each anchor having a mass significantly greater than water for placement on a bottom of an aquatic body and each having a coupling fixture. The assembly also includes a plurality of anchor lines with each anchor line having a first end for attachment to one of the coupling connectors of the stabilizer assembly and a second end for attachment to the coupling fixture of one of the anchors. One or more floatation devices is coupled to at least one of the elongated body and the stabilizer assembly and their sum of their buoyancy is selected to provide substantial floatation of the elongated body and the stabilizer assembly following mounting of an antenna to the RFID antenna mounting assembly. The system also includes an aquatic antenna mounting assembly being positionable proximate to the aquatic timing point and an RFID antenna mounted on the RFID antenna mounting assembly. The RFID antenna is communicatively coupled to the radio frequency transceiver of the RFID tag reader system with the RFID tag reader system being configured for transmitting a tag read request from the antenna to the RFID tag and receiving at the antenna one or more tag reads from the RFID tag and also transmitting the tag read request and the tag reads between the RFID tag reader system and the antenna.

Further aspects of the present disclosure will be in part apparent and in part pointed out below. It should be understood that various aspects of the disclosure may be implemented individually or in combination with one another. It should also be understood that the detailed description and drawings, while indicating certain exemplary embodiments, are intended for purposes of illustration only and should not be construed as limiting the scope of the disclosure.

BRIEF DESCRIPTION OF THE DRAWINGS

It should be understood that throughout the drawings, corresponding reference numerals indicate like or corresponding parts and features.

DETAILED DESCRIPTION

Figure 1:
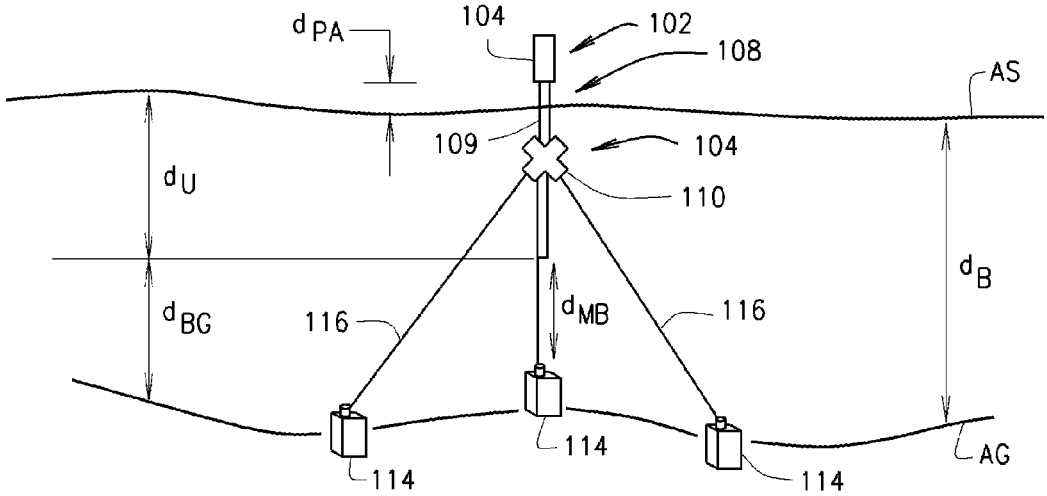
FIG. 1 is a side view of an aquatic tag reader mounting assembly installed at an aquatic timing point according to one exemplary embodiment.

The following description is merely exemplary in nature and is not intended to limit the present disclosure or the disclosure's applications or uses.

A system and method for determining the passing of a participant of an aquatic event by a water-based timing point including an RFID tag associated with the participant, an aquatic based RFID tag reading point having one or more aquatic tag reading assemblies placed in the water, each aquatic tag reading assembly having one or more RFID tag readers mounted thereon at a position above the surface of the water on an aquatic tag reader mounting assembly, the aquatic tag reader mounting assembly having a portion below the surface of the water and including at least one float system and at least one stabilization system.

In some embodiments, an assembly for use with an event timing system for determining a timing of passing of an aquatic timing point by a participant participating in a timed aquatic event, the participant has an RFID tag with a unique participant identifier. The participant can be a person, a boat, a vehicle or any other water based device.

The RFID antenna mounting assembly includes an elongated body having an upper end and a lower end, and a middle portion positioned between the upper end and the lower end. The elongated body can be of any form or construction. The elongated body is selected and configured for having the upper end positionable above the water line, with the lower end being positioned downward towards the bottom of the aquatic body. In some embodiments, the elongated body can be made of a metal or a plastic, can be round or rectangular. For example, in one embodiment, the elongated body can be primarily formed from a single tube of PVC and with enclosed or sealed adding buoyancy, or open for allowing in water into its center cavity. In other embodiments, the elongated body can be formed from more than one member.

An RFID antenna mounting assembly is attached proximate to the upper end of the elongated body configured for mounting an RFID antenna. This can be of any form and is often configured or provided based on the particular antenna to be mounted to the upper end of the elongated body. In some cases, the antenna mounting assembly can be single sided, but in others it can have two opposing sides for mounting two antennas in opposite facing directions. Of course it could also be configured for more sides and more antennas. The RFID antenna mounting assembly can be mounted to the top or upper end of the elongated body or to one of the sides proximate to the upper end. The antenna mounting assembly is positioned to be above the water level so that the mounted antenna thereon is above the surface of the water a predetermined distance for reading the RFID tags. This distance can be adjusted based on the expected position of the tags relative to the surface of the water (on a swimmer versus on a boat) as well as the expected read distance laterally within the water or from the antenna mounting assembly.

In some embodiments, one or more floatation devices are coupled to the elongated body at the middle portion thereon. These can aid in keeping the elongated body in a vertical or substantially vertical position in the water.

A stabilizer assembly is located at a fixed vertical position of the middle portion of the elongated body and includes a plurality of radially spaced apart coupling connectors. The stabilizer assembly is typically attached to a center portion of the elongated member for attachment of flotation devices for adding buoyancy as well as anchors for anchoring the antenna mounting assembly to a fixed position on the bottom of the aquatic body. In some embodiments, the stabilizer assembly includes a plurality of lateral members extending substantially perpendicular from the elongated body and wherein at least a portion of the coupling connectors are positioned proximate to a distal end of the lateral members. However, they do not have to be substantially perpendicular to the elongated body and can be placed at angles to the body or forming a superstructure about the elongated body. In other embodiments, the elongated body can be formed as a multi-frame structure with an upper extension. In such embodiments, the stabilizer assembly can be formed as an integral part of the elongated body, such as a central or lower portion thereof.

A plurality of anchors with each anchor having a mass significantly greater than water is configured for placement on a bottom of an aquatic body. Each anchor includes a coupling fixture. In some embodiments, the anchors are essentially just dead weights that can be temporarily or permanently placed on the bottom of the aquatic body at the place where the aquatic timing point is being defined.

A plurality of anchor lines is provided having first ends for attachment to one of the coupling connectors of the stabilizer assembly and second ends for attachment to the coupling fixture of one of the anchors. The anchor lines can be of a fixed length or can have at least one of the first end and the second end that is configured for adjusting a length of the anchor line and securing the adjusted length at a defined length position or at an adjustable position. Such an adjustable anchor line embodiment can useful to aid in the setting up of the antenna mounting assembly, or adjusted such to adjust the height of the upper end of the elongated body that extends above the surface of the water or for changes to the water level or turbulence such as due to a change of the tide.

One or more floatation devices can also be coupled the stabilizer assembly as well as to the elongated body or in the alternative thereto. Regardless, the floatation devices are selected, configured and or dimension to have a sum of a buoyancy to provide substantial floatation of the elongated body and the stabilizer assembly following mounting of an antenna to the RFID antenna mounting assembly. In some embodiments, the sum of the buoyancy of the floatation devices on the antenna mounting assembly is provided to be greater than the weight of the elongated body, the stabilizer assembly and the mounted antenna thereby providing for the floatation of the antenna mounting assembly until such is weighted down or tied down to the bottom of the aquatic body via the anchors and anchor lines. The upward floatation forces and their position on the assembly combined with the downward anchoring forces of the anchor lines and the anchors provides for stabilization of the antenna mounting assembly at the aquatic timing point in the water under a wide array of water conditions.

The floatation devices can be placed along the stabilizer assembly spaced apart and in some embodiments at least a portion of one or more floatation devices is positioned proximate to the distal ends of the lateral members that are spaced apart from the elongated body to provide a wider footprint in the water and under the surface of the water to increase stabilization in the water especially where water turbulence is greater. In such cases, lateral members can be extended outward to increase the in water footprint of the stabilizer assembly. In some embodiments, at least a portion of the one or more floatation devices is positioned on a lateral member proximate to the elongated body.

In some exemplary embodiment, the stabilizer assembly includes two elongated members having two opposing distal ends and a middle with each of the two elongated members attached to the elongated body about at the middle of each elongated member and positioned perpendicular to each other. Of course additional elongated members can be added to the standard X-pattern and can be formed into a star pattern or can be formed to include outward members for connecting the middle or distal ends of two or more of the elongated members that extend outward from the elongated member that is typically positioned near the center or middle point of the stabilizing assembly. As with the elongated body, the stabilizing member elements or elongated members can be of any suitable material or design, and can be a metal or PVC tube type structure in one embodiment, by way of example and not limited thereto.

In some embodiments, the stabilizer assembly can include on ore more supports to add strength and support to the elongated members and their attachment to the elongated body. For example, in some embodiments, each support has a first end coupled to a spaced apart position of the elongated body and a second end coupled to one of the elongated members at a positioned spaced apart from its connection to the elongated body. These can be on the upper end of the elongated body or the lower end or both. The supports can be of any form and made from any material and in one exemplary embodiment can be formed from metal or plastic rigid elements, or from cable or metal or other line material.

Of course with antenna mounting assembly, some embodiments can include the RFID antenna that is mounted to the RFID antenna mounting assembly. As will be discussed in more detail below, the RFID antenna is communicatively coupled to an RFID tag reader system positioned remote from the assembly for receiving and transmitting RF signals and messages there between and for providing power to the antenna for operation of reading the passing RFID tags. As noted above, the RFID antenna mounting assembly can have two opposing sides for mounting a first RFID antenna on a first side and a second RFID antenna on a second side. In such, embodiments, a first RFID antenna is mounted to the first side of the RFID antenna mounting assembly and a second RFID antenna is mounted to a second side of the RFID antenna mounting assembly. The first antenna can be configured for reading RFID tags in a first direction towards the first side and the second antenna can be configured for reading RFID tags in a direction of the second side.

Several exemplary embodiments of aquatic RFID antenna mounting assemblies are shown in FIGS. 1 and 2 and FIGS. 3-5. Further one exemplary embodiment of a recently reduced to practice RFID antenna mounting assembly is shown in the illustrations of FIGS. 6-9. Each of these exemplary embodiments will now be described.

FIG. 1 illustrates an aquatic tag reader antenna mounting assembly 102 that includes the antenna mounting assembly 108 (which is also referred herein generically as assembly 102) installed at an aquatic timing point (ATP) 101 according to one exemplary embodiment. As shown, an aquatic antenna mounting assembly 102 has a stabilizer assembly 110. In this embodiment an elongated body 109 along with the stabilizer assembly 110 provides the function of buoyancy to the assembly 102. A plurality of anchors 114 are positioned spaced apart on the aquatic bottom AB of the body of water that has a depth below the aquatic surface AS of $d_B$. The tie lines 116 secure the stabilizing assembly 110 to the anchors in a fixed position that defines the aquatic timing point. The RFID tag reading antenna 104 is mounted to the upper end of the elongated body 109 that is extending above the aquatic surface AS at a distance defined as $d_{PA}$. The elongated body has a length that extends a distance of $d_U$ below the aquatic surface AS and when positioned in the water is a distance $d_{BG}$ above the aquatic bottom. Typically, the length of distance $d_{BG}$ can be substantially greater than the length of the elongated body defined by $d_U+d_{PA}$. The distance $d_{MB}$ is the length of the tie lines from the stabilizing assembly to the anchors 114 that are located on the aquatic bottom AB.

Figure 2:
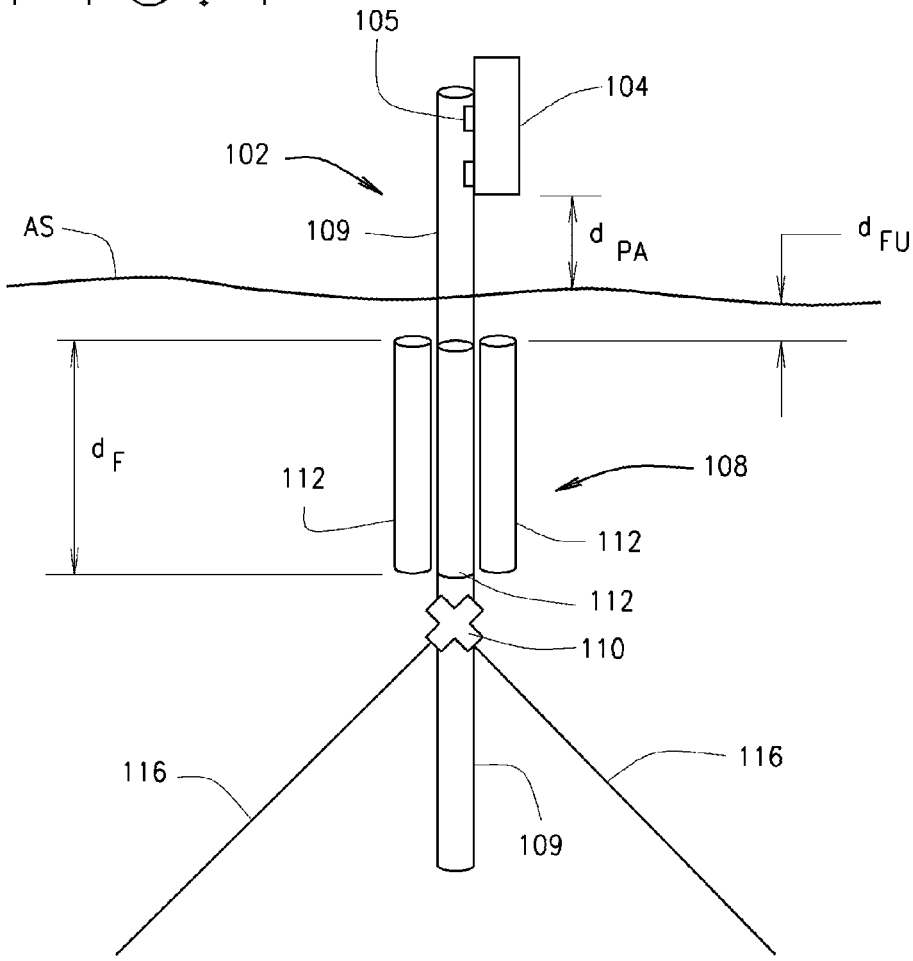
FIG. 2 is a side view of an aquatic tag reader mounting assembly installed at an aquatic timing point according to another exemplary embodiment.

FIG. 2 illustrates another embodiment of an aquatic antenna mounting assembly 102 having antenna mounting brackets or assembly 105 positioned on the side of the upper end of a cylindrical elongated body 109 to which the antenna 104 is attached at a distance of $d_{PA}$ above the aquatic surface AS. In this embodiment, for illustration of another embodiment, a plurality of floatation devices 112 or floats each having a float length of $d_F$ are mounted directly to the outer sides of the elongated body 109. The aquatic antenna mounting assembly is positioned in the water and secured to the aquatic bottom via tie lines 116 so that the tops of the floatation devices 112 are a distance of $d_{FU}$ under the aquatic surface and the bottom of the antenna 104 that is mounted to the antenna mounting assembly 105 is a distance of $d_{PA}$ above the aquatic surface AS.

As will be understood by those of skill in the art, the aquatic antenna 104 can be any type of antenna for reading of a passing participant RFID tag or identifier. In some embodiments, the participant identifier is an RFID tag that can be an active RFID tag or a passive RFID tag, depending on the selection and use. Generally, herein, this disclosure will refer to RFID tags generally, but it should be understood that this is only for short hand and that any other type of participant identifying element or tag can also be applicable. As such, the aquatic antenna 104 can be the appropriate antenna for reading the selected participant tag and will generally be referred herein as an RFID Tag Reader Antenna or just antenna 104. These can be specialized water resistance or water proof RFID antenna such as an antenna which may be helpful in ensuring their operation under aquatic use conditions. Further, in some embodiments the RFID antenna 104 can be adapted to have specialized and adapted characteristics such as selection of an RF polarization, power or encoding, the selection of which may be customized to increase the performance in the presence of RF absorbing water and other antenna 104 in multiple antenna 104 installation. All such are considered within the scope of the present disclosure.

Figure 3:
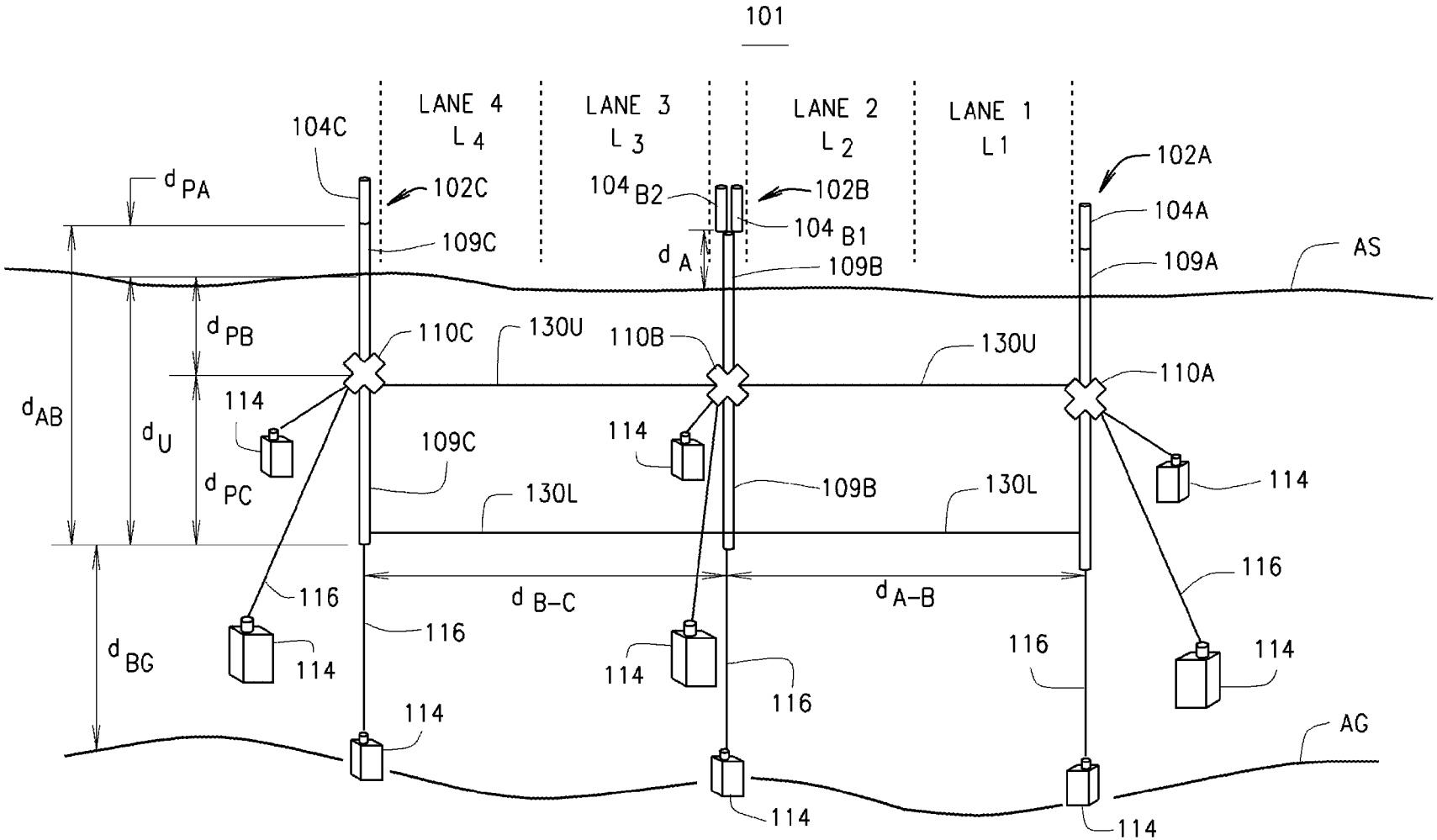
FIG. 3 is an end view of an aquatic timing point utilizing three aquatic tag reader mounting assemblies installed at an aquatic timing point for reading of passing RFID tags in four RF defined aquatic timing lanes according to one exemplary embodiment.

FIG. 3 illustrates an aquatic timing point 101 having three aquatic antenna mounting assemblies 102A, 102B, and 102C installed to define the aquatic timing point 101 for reading of passing RFID tags in four participant lanes, L1, L2, L3 and L4. Such lanes LN being in water may not be defined or definable on the aquatic course of the aquatic timed event and can be defined RFID tag reading positions in the water. In this example, each of two lanes L1 and L2 are positioned between two sets of aquatic antenna 104A and 104B1 and two lanes L3 and L4 are defined positions between aquatic antenna 104B2 and 104C. In this case, antenna 104A that is mounted on elongated body 109A with floatation assembly 110A forming aquatic antenna mounting assembly 102A is positioned to read RFID tags in participant lane L1. Antenna 104B1 that is mounted on the right side of elongated body 109B with floatation assembly 110B forming aquatic antenna mounting assembly 102B is positioned to read RFID tags in participant lane L2. Similarly, antenna 104Be that is mounted on the left side of elongated body 109B with floatation assembly 110B forming aquatic antenna mounting assembly 102B and is positioned to read RFID tags in participant lane L3 and antenna 104C that is mounted on elongated body 109C with floatation assembly 110C forming aquatic antenna mounting assembly 102C and is positioned to read RFID tags in participant lane L4. As the aquatic timing point 101 utilizes multiple RFID antenna mounting assemblies 102A, 102B, and 102C for reading RFID tags in the water defined four participant lanes L1, L2, L3 and L4, two lateral support lines coupled each of the antenna mounting assemblies 102A, 102B, and 102C to the adjacent one. As shown, upper lateral stabilizing line 130U couples stabilizer assembly 110A to stabilizer assembly 110B and then couples stabilizer assembly 110B to stabilizer assembly 110C. Similarly, lower lateral stabilizing line 130L couples the lower end of the elongated body 109A to the lower end of the elongated body 109B and then couples the lower end of the elongated body 109B to the lower end of the elongated body 109C. In this manner, each of the antenna mounting assemblies 102A, 102B, and 102C is stabilized with respect to each other without interfering with the participant lanes L1, L2, L3 and L4 or the participants therein.

Figure 4:
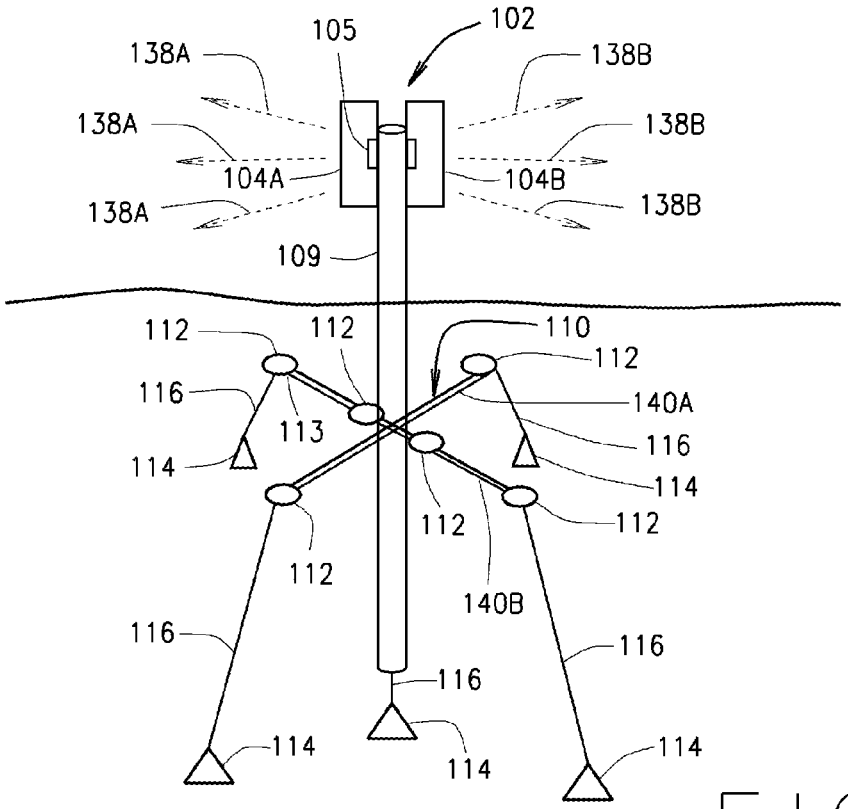
FIG. 4 is a side view of another aquatic tag reader mounting assembly having an extended float and stabilization system installed at an aquatic timing point according to another exemplary embodiment.

FIG. 4 provides another embodiment of the aquatic mounting assembly 102 according to another embodiment. In this illustration, there are two antenna 104A and 104 mounted proximate to the upper end of the elongated body 109 on opposing sides thereof. Antenna 104A transceives RF energy 138A to and from passing RFID tags on the left side of the assembly 102 and antenna 104B transceives RF energy 138B to and from passing RFID tags on the rights side of the assembly 102. In this illustration, the RF signal paths are illustrated from antennas 104A and 104B and such RFID signal paths can penetrate the water below the surface AS to a distance of RD the read depth wherein the RFID tag can be located below the aquatic surface AS.

Further, in this exemplary embodiment, the stabilizing assembly 110 includes a stabilizing assembly frame 140 having two lateral members 140A and 140B formed in an X-shape each of which extend outward from the vertically positioned elongated body 109. In this example, the elongated body 109 includes a bottom end that is secured to an anchor 114 via anchor line 116 which is directly below the elongated body 109. The distal ends 113 of each of the lateral members 140A, 140B are coupled to anchor lines 116 with each also being coupled to anchors 114. Floatation devices 112 are positioned proximate to the distal ends 113 of each lateral member 140A, 140B as well as proximate to the elongated body 109.

Figure 5:
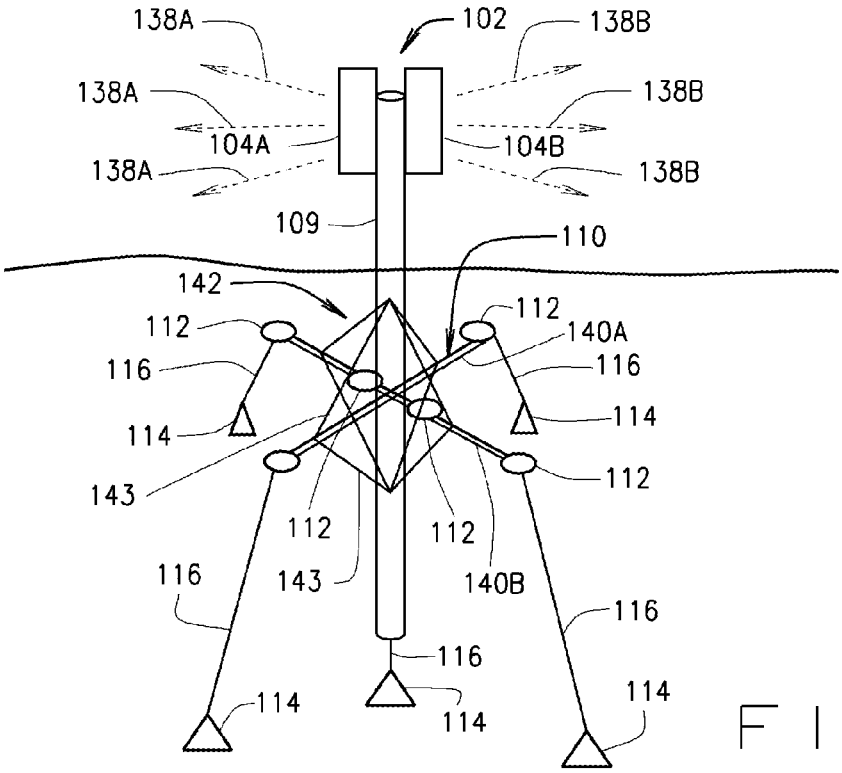
FIG. 5 is a side view of another embodiment of an extended float and stabilization system with additional stabilizing lines according to yet another embodiment.

In another embodiment, FIG. 5 illustrates an antenna mounting assembly 102 that is similar to that shown in FIG. 4 but in this example, an extended float and stabilization system 110 includes additional stabilizing support assembly 142 with support lines 143 extending from middle portions of the lateral members 140A, 140B to a spaced apart position of the elongated body 109 that is above and below the stabilizing assembly 110. In this embodiment, the stabilizing support assembly 142 can provide for enhanced stability of the upper end of the elongated body 109 and in particular the antenna 104 mounted thereon. In this example, both upward and downward frame stabilizer lines 143 are used, but in other embodiments only a single set of such lines 143 may be all that is required or desired.

Figure 6:
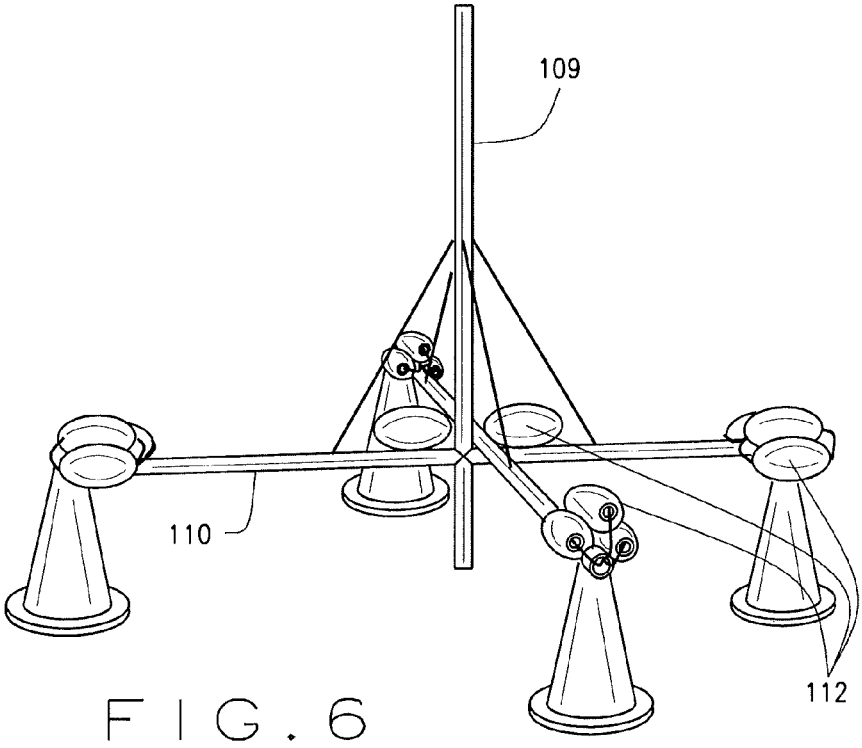
FIG. 6 is a perspective view illustration of an aquatic tag reader mounting assembly having an extended float and stabilization system assembled in preparation of an experimental test installation according to one exemplary embodiment.
Figure 7:
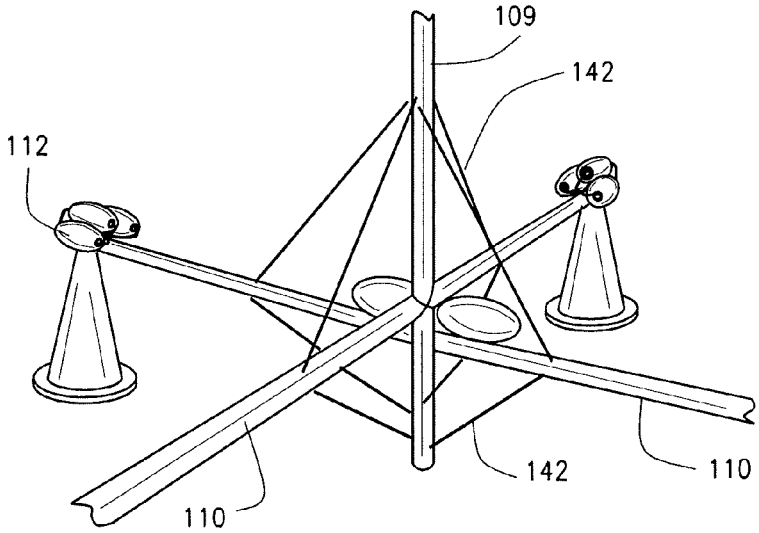
FIG. 7 is a perspective view illustration that is a close up of the system of FIG. 7.
Figure 8:
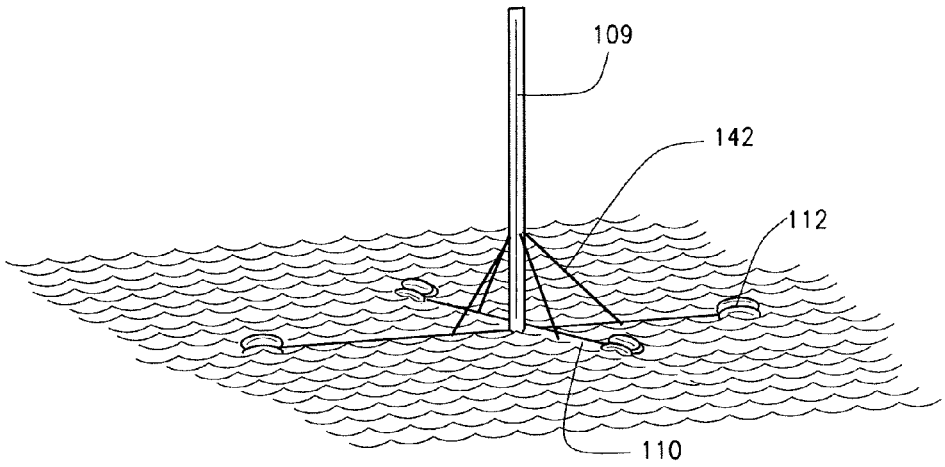
FIG. 8 is a perspective view illustration of the system of FIGS. 6 and 7 placed in the water and being prepared for installation and submersion of the extended float and stabilization system.
Figure 9:
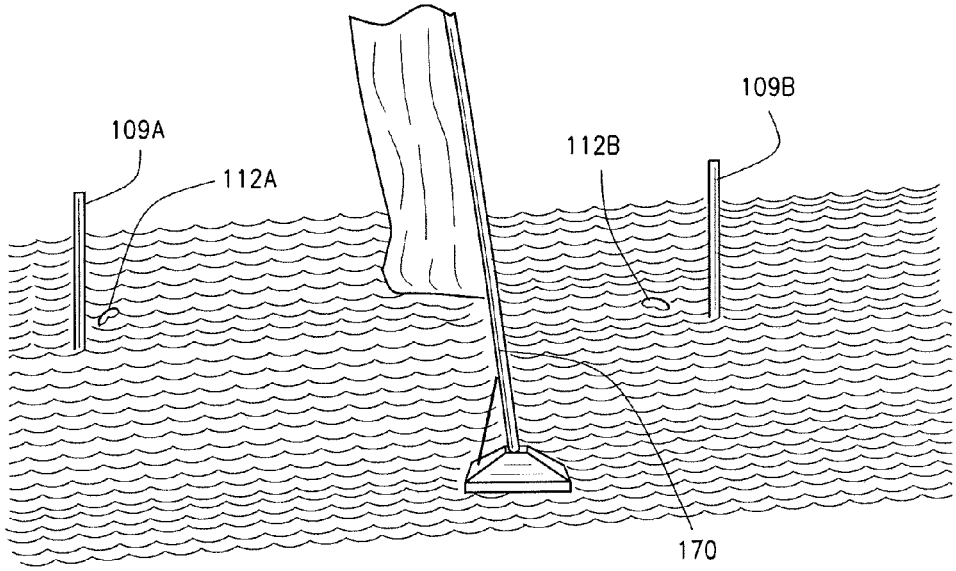
FIG. 9 is a perspective view illustration of an aquatic timing point with two aquatic tag reader mounting assemblies installed at a timing point with the stabilization systems submerged and in preparation for the mounting of the antenna onto the aquatic tag reader mounting assemblies according to one exemplary embodiment.
Figure 10:
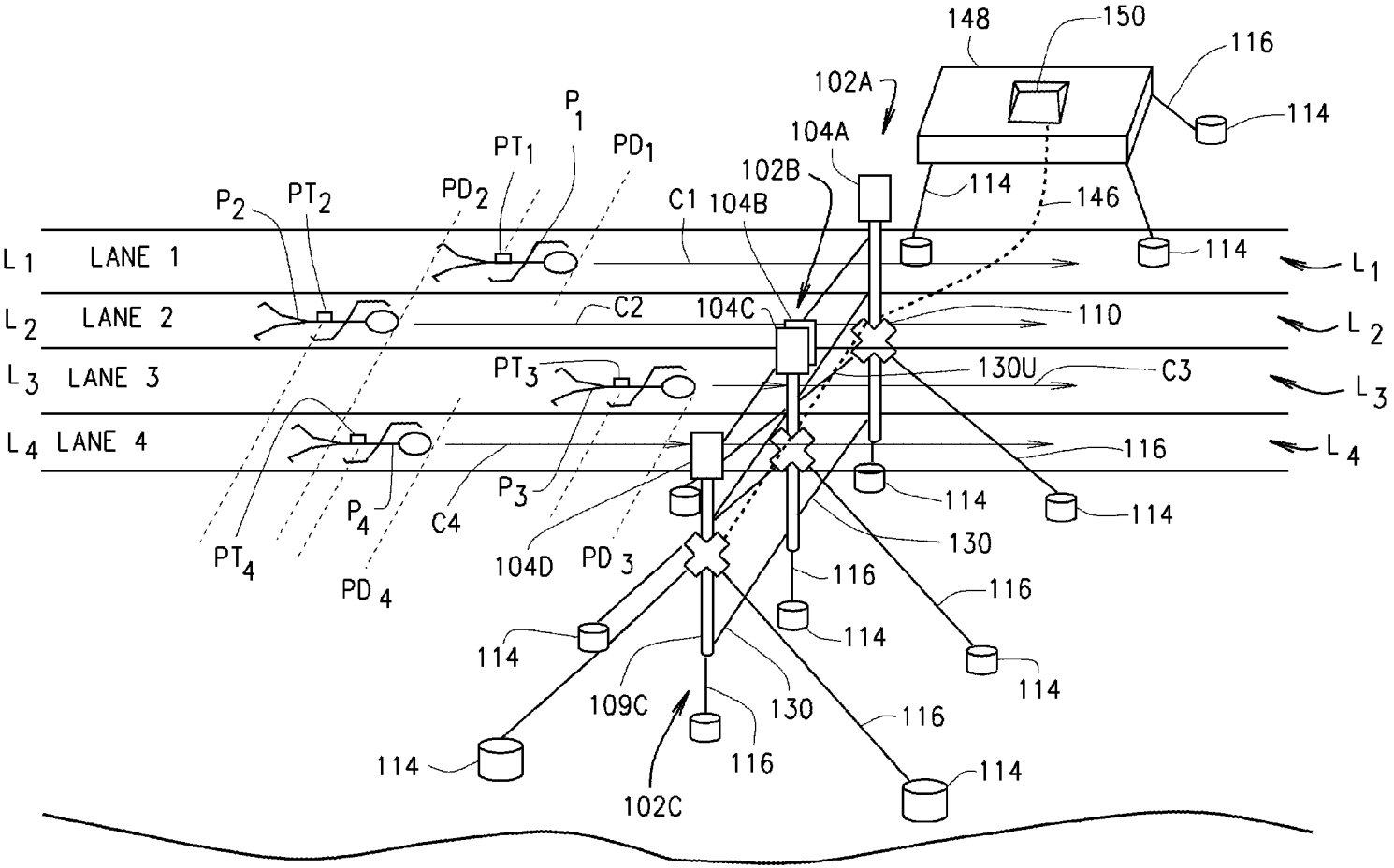
FIG. 10 is a top perspective view of an aquatic timing point system installed at an aquatic timing point having four aquatic timing lanes with three aquatic RFID antenna mounting assemblies for RF reading the passing participant RFID tags and with an associated aquatic timing RFID tag reader and/or timing system according to one exemplary embodiment.

During testing of some embodiments of the aquatic antenna assembly 102, the inventor continued to refine the design of the aquatic antenna mounting assembly 102 and its stabilization assembly 110 for use in aquatic timed events. At the time of the filing of the priority provisional application, the inventor continued to test and refine this design. One such design being tested is shown being tested in FIGS. 6-9. FIG. 6 is a an illustration of an aquatic tag reader mounting assembly 102 having an extended stabilization assembly 110 with floats 112. This assembly 102 is being prepared on land for an experimental test installation on water. FIG. 7 is an illustration that is a close up of the aquatic antenna mounting assembly being tested as shown in FIG. 6 and shows the stabilizing support assembly 142 and lines thereof. FIG. 8 is an illustration of the aquatic antenna mounting assembly 102 of FIGS. 6 and 7 being positioned in the water for installation and submersion therein. FIG. 9 is an illustration of an aquatic timing point 101 defined by two aquatic antenna mounting assemblies 102A and 102B and showing their upper ends of the elongated bodies 109A, 109B extending above the aquatic surface after the stabilizing assembly has been submerged by securing the assemblies 110A, 110B to submerged anchors (not shown) via anchor lines (not shown). Each aquatic antenna mounting assembly 102A, 102B is now prepared for attachment of antennas (not shown) for the test. These FIGS. 6-9 are only exemplary and are not intended to be limiting.

Aquatic Tag Reader System

In other embodiments, a system is provided for recording a passing of a participant participating in a timed aquatic event past an aquatic timing point with the participant having an RFID tag with a unique participant identifier. The system includes an RFID tag reader system having a processor, a memory, a clock, a communication interface, a radio frequency transceiver for generating a wireless communication with the RFID tag via an antenna.

In some embodiments, a tag reader platform is provided with a platform body with buoyancy or additional platform floats and a plurality of platform anchors each attached to a spaced apart portion of the platform body by an anchor line. Other floating platforms such as a boat are also suitable where they can be anchored in a fixed position relative to the aquatic antenna mounting assembly/assemblies having the RF antenna and within RF communication therewith, which is often an RF cable or wired connection.

A radio frequency communication cable can couple the RFID antenna to the radio frequency transceiver of the RFID tag reader system. In some embodiments, the aquatic antenna mounting system includes securing fixtures for securing the communication cable in a fixed position relative to the elongated body. As described above, the RF cable can be of any suitable design and in some embodiments can include a conduit having an air tight cavity and an RF transmission line positioned within the air tight cavity coupling the RFID tag reader to the antenna mounted on the aquatic antenna mounting assembly as described above. This can include, but is not limited to, a rigid or flexible conduit. The RF transmission line can include, but is not limited to a coax line.

An aquatic antenna mounting assembly has an elongated body with an upper end and a lower end, and a middle portion positioned between the upper end and the lower end. An RFID antenna mounting assembly is attached proximate to the upper end of the elongated body for mounting an RFID antenna.

The aquatic mounting assembly includes a stabilizer assembly located at a fixed vertical position of the middle portion of the elongated body and a plurality of radially spaced apart coupling connectors. The aquatic mounting assembly also includes a plurality of anchors, each anchor having a mass significantly greater than water for placement on a bottom of an aquatic body and each having a coupling fixture. A plurality of anchor lines is provided with each anchor line having a first end for attachment to one of the coupling connectors of the stabilizer assembly and a second end for attachment to the coupling fixture of one of the anchors. The assembly includes one or more floatation devices coupled to at least one of the elongated body and the stabilizer assembly. The flotation devices are configured and or selected so that the sum of their buoyancy provides a substantial floatation of the elongated body and the stabilizer assembly following mounting of an antenna to the RFID antenna mounting assembly.

The aquatic antenna mounting assembly is positionable proximate to the aquatic timing point. The system also includes an RFID antenna mounted on the RFID antenna mounting assembly. The antenna is communicatively coupled to the radio frequency transceiver of the RFID tag reader system.

The RFID tag reader system is configured for transmitting a tag read request from the antenna to the RFID tag of the participant and for receiving at the antenna one or more tag reads from the RFID tag, and then transmitting the tag read request and the tag reads between the RFID tag reader system and the antenna.

Referring back to the exemplary embodiments shown in the drawings, an aquatic timing point 101 is illustrated having four aquatic participant lanes L1, L2, L3, L4 each with a swimming participant P1, P2, P3, P4 and each with participant tag PT1, PT2, PT3, PT4 respectively. Each is traveling an aquatic course C1, C2, C3, C4 also respectively. Three aquatic antenna assemblies 102A, 102B, 102C are positioned at the aquatic timing point 101 and are coupled to an RFID tag reader 150 via communication link 146. The RFID tag reader 150 is positioned on a platform 140, which in this example is anchored via anchor lines 116 to anchors 114 that are positioned on the aquatic ground AG similar to the anchoring of aquatic antenna assemblies 102A, 102B, 102C. The antennas 104A, 104B, 104C, 104D are configured for reading the passing participant tags PT1, PT2, PT3, PT4 when they are in read range thereof. As shown, antenna 104A mounted to aquatic antenna mounting assembly 102A is positioned and configured for reading participant tag PT1 of participant P1 that is in L1 and traveling along course C1. The antenna read of antenna 104A is provided to the RFID tag reader 150 via communication link 146 and the RFID tag reader 150 or a timing system integrated therewith or remote can determine the participant position PD1 as well as the passing of the participant P1 at a defined aquatic timing point 101 that is consistent for all lanes L1, L2, L3, L4 thereof. The antenna read of antenna 104B is provided to the RFID tag reader 150 via communication link 146 and the RFID tag reader 150 or a timing system integrated therewith or remote can determine the participant position PD2 as well as the passing of the participant P2 at the aquatic timing point 101. The antenna read of antenna 104C is provided to the RFID tag reader 150 via communication link 146 and the RFID tag reader 150 or a timing system integrated therewith or remote can determine the participant position PD3 as well as the passing of the participant P3 at the aquatic timing point 101. The antenna read of antenna 104D is provided to the RFID tag reader 150 via communication link 146 and the RFID tag reader 150 or a timing system integrated therewith or remote can determine the participant position PD4 as well as the passing of the participant P4 at the aquatic timing point 101.

Figure 11:
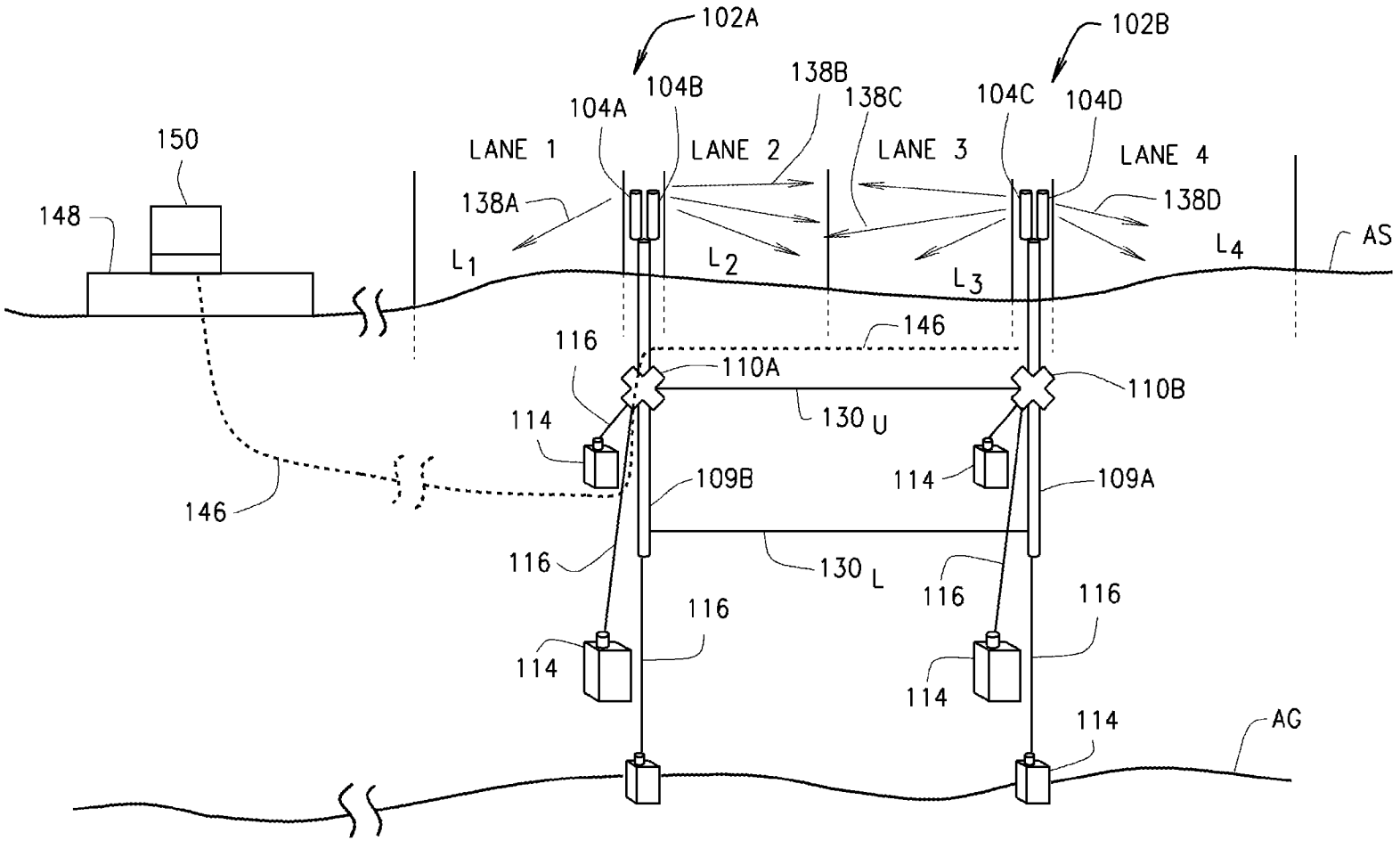
FIG. 11 is an end view of an aquatic timing system having two RFID antenna tag reader mounting assemblies for reading RFID tags at an aquatic timing point according to another exemplary embodiment.

Another embodiment another aquatic timing point 101 is shown in FIG. 11 having the aquatic RFID tag reader 150 that can also be a timing system coupled via communication cable 146 to four antenna 104, two antenna 104A, 104B are mounted on aquatic antenna mounting assembly 102A with each opposing the other. Two other antennas 104C, 104D are mounted on aquatic antenna mounting assembly 102B and are also opposing each other. Upper lateral support 130U laterally stabilizes the stabilization assembly 110A relative to stabilization assembly 110B and lower lateral support 130L laterally stabilizes the lower end of elongated body 109A relative to the lower end of elongated body 109B.

Figure 13:
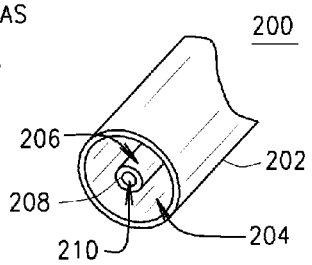
FIG. 13 is an RF antenna cable assembly for the aquatic tag reader and RFID antenna mounting assembly according to one exemplary embodiment.

FIG. 13 illustrates an example of such an RF antenna cable assembly 200 suitable for use as a communication cable 146 for communicatively coupling the aquatic tag reader system 150 to each of the aquatic antenna 104. As shown in this embodiment, the communication cable 200 includes a RF transmission line 206 that is positioned in a water tight, sealed conduit 202 defining a cavity 204 in which the RF line 206 is placed. The cavity 204 can be filled with air or a gas. The RF cable 206 is smaller than the cavity 204 of the so that the air within the cavity 204 can improve the RF performance of the conduit that is immersed in water. In this example, the RF cable 206 is a coax cable with a shield conductor 208 and an isolated center conductor 210.

In these examples of FIG. 11, the two aquatic antenna mounting assemblies 102A, 102B are positioned between lanes L1, L2 each with two aquatic antennas 104 attached thereto. Each aquatic antenna 104 is directed to a lane LN as shown. In this embodiment, the aquatic antenna can be highly directional antennas that have narrow RF beam patterns and that are directed, not in front of the antennas but directly across. The RFID tag reader 150 or timing system equipped therewith s adapted to determine the aquatic timing point 101 and the participant location PDN by determination of the location by signal strength of the RFID tags PTN. In some embodiments, as the aquatic antenna 104 are located in close proximity to each other and some are directed towards each other, the RFID tag reader system 150 is adapted to address interference and read rate issues. As such, in some embodiments, the aquatic antenna 104 can be configured to utilize a different polarization. For example, two antenna 104 such as 104A and 104B which are facing each other and which can have highly direct and narrow antenna patterns can be separately polarized such as one having a right hand circular polarization and the other having a left hand circular polarization. This is just one example, and other polarization variations are also possible and within the scope of the present disclosure.

The aquatic RFID tag reader system 150 can further be adapted in various embodiments so as to adjust or modify the tag readings by the antenna 104 from each of the antenna 104N such as those in the example of FIG. 11. For example, the aquatic RFID tag reader 150 can be adapted so that the antenna 104N are activated for reads in an alternating or rotating scheme such as from 104A, then 104C, then 104B, and then 104D. Other schemes are also possible, but the concept herein is that the aquatic RFID tag reader 150 can be adapted so that no two potentially conflicting aquatic antenna at the aquatic timing point 101 are reading in the same direction or directly at a facing antenna 104. In this manner also, the use of the highly direct but facing antennas 104 can minimize RF interference and improve the overall system performance.

In other embodiments, the aquatic RFID tag reader 150 can be adapted to reduce the number of tags read by each aquatic antenna 104 on each activation. Generally, each aquatic antenna 104 can be adapted to vary the amount of time that the aquatic antenna 104 is active for reading and obtaining tag reads. This tag reading inventory time can be reduced and rotated by the aquatic RFID tag reader system 150 more rapidly as in the above modified rotation, to improve tag reading performance. For example, in some instances, the aquatic tag reader system 150 can be adapted to reduce the antenna inventory times significantly down to $1/10^{th}$ or $1/20^{th}$ of a second or further. In this manner, each antenna 104 is active for less time, but the rotation among the multiple antennas 140 can be sped up.

In other embodiments, the aquatic tag reader system 150 can be adapted to narrow down the aquatic tag reads and eliminate problems with multiple and interfering tag reads. For example, in one embodiment, the system 150 is adapted to obtain one or more tag reads from a particular participant tag PT. After the system 150 obtains the desired tag read of the participant PT from an antenna 104, the system 150 can transmit via one of the reading antenna 104 a command to the participant tag PT to go into a sleep mode or to turn off for a defined period of time. In this manner, the participant tag PT such as a passive RFID tag will not respond to further RF messages from any of the antenna 104 until the passing of the sleep time. Times such as between 2 to 5 seconds have been determined to be desirable in some embodiments. The sending of such, can be after a single tag read, or after a determined tag read is the tag read that is the desired tag read for the determining the passing of the participant tag PT by the virtually defined aquatic timing point 101.

Figure 12:
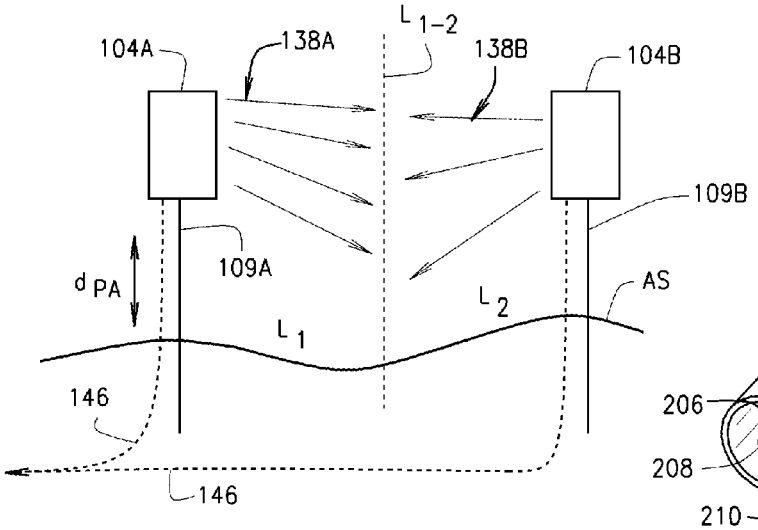
FIG. 12 is a side view of an aquatic tag reader system RFID antenna mounting assembly having two facing antennas for covering two adjacent timing lanes at an aquatic timing point according to one exemplary embodiment.

FIG. 12 provides is a side view of an aquatic timing point 101 having two opposing antennas 104A and 104B mounted on spaced apart aquatic mounting assemblies 102A and 102B. As shown, the antenna 104A transmits RF energy 138A in the direction of antenna 104B and antenna 104B transmits RF energy 138B in the direction of antenna 104A. The tag reader system 150 receives the RFID tag reads from each of antenna 104A and 104B and defines a separation of lane L1 from lane L2 as shown by line L1-2 based on the strength of the received RF signals by each antenna 104A, 104B.

Figure 14:
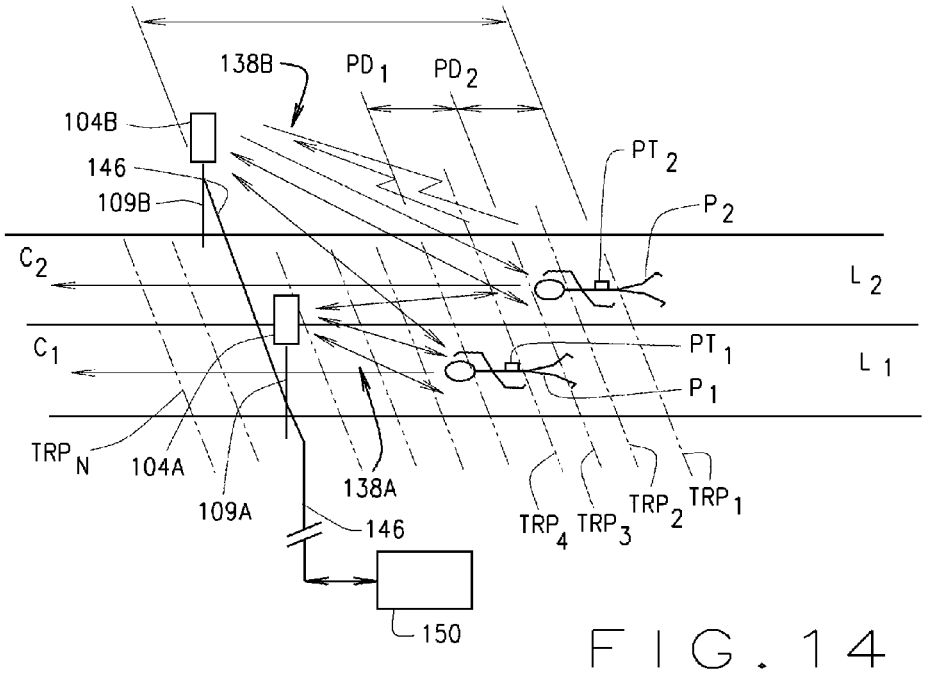
FIG. 14 is a top perspective view of an aquatic timing point system in operation reading the aquatic RFID tags of two swimmers approaching an aquatic timing point by an aquatic tag reader system with two aquatic RFID antenna mounting assemblies according to one exemplary embodiment.

FIG. 14 is an example of an aquatic tag reader 150 using aquatic antenna 104 for reading tags as swimmers P approaching the aquatic timing point 101. As shown, each aquatic antenna 104 can read each approaching tag and the read distance can be up to and including 30 to 40 feet prior to the virtual aquatic timing point 101. As shown, the RFID tag reader 150 provides RF energy to each of the antenna 104A, 104B and each antenna 104A, 104B transmits RF energy 138A, 138B respectively for activating and reading the participant RFID tags PT1, PT2. These are performed multiple times at multiple positions as each participant P1 and P2 approach the aquatic timing point 101 as shown as tag reads TRP1, TRP2, TRP3, TRP4, through TRPN. In this manner, the RFID tag reader 150 or a timing system related thereto can determine the position of participant P1 at PD1 and the position of participant P2 at PD2 and then compare to determine the timing of passing of the aquatic timing point 101 based thereon.

Figure 15:
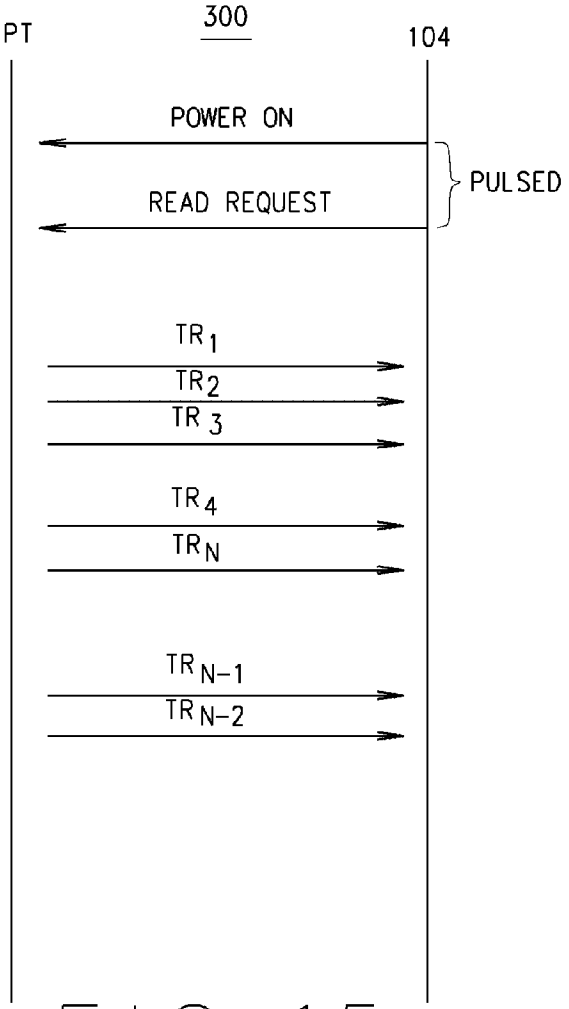
FIG. 15 is a timing diagram of a communication protocol showing three tag readers by three aquatic RFID antennas at a single aquatic timing point for a single RFID tag reader system according to one exemplary embodiment.

FIG. 15 illustrates a timing diagram 130 for the communications between antenna tag reader systems 150 and antenna 104 as participant tag PT passes by a monitored aquatic timing point 101. As shown, the tag reader system 150 transmits a power on message and a read request message to each antenna that gets transmitted at the monitored aquatic timing point 101. Each of these is pulsed wirelessly and continuously by antennas 104A, 104B and 104C that are located at the same monitored aquatic timing point 101. A first set of antenna tag reads $ATR_{A1}$, $ATR_{B1}$ and $ATR_{C1}$ are received by a tag reader system antenna 150 from the participant tag PT. Each of these is received from different antenna 104A, 104B, and 104C at the aquatic timing point 101, and hence the first sub character of the antenna reads correlating therewith. As the participant tag PT continues to move and time lapses and the participant tag PT continues to transmit tag reads which are received by the tag reader system 150 as $ATR_{A2}$, $ATR_{B2}$, and $ATR_{C2}$. The participant tag PT continues to move in range of the antenna 104 and final antenna tag reads $ATR_{A3}$, $ATR_{B3}$, and $ATR_{C3}$ are obtained from antenna 104. Each of the three antenna tag reads per antenna 104 are communicated to a coupled tag reader system 150 all while the participant tag PT is within proximity to the same monitored point and in wireless communication with the antennas 104A, 104B, and 104C associated therewith. In this embodiment, all antenna tag reads occur at a single aquatic timing point 101 having multiple antennas. The processes discloses herein determine the actual passing of participant tag PT by this aquatic timing point 101 in view of these multiple antenna tag reads.

Aquatic Event Timing System

In another embodiment, a system is provided for timing a plurality of participants participating in a timed aquatic event as they travel past at least one aquatic timing point, each participant having an RFID tag with a unique participant identifier. the system includes an event timing system having a processor for executing computer executable instructions, a memory for storing the computer executable instructions, and a communication interface. The event timing system is configured for receiving over the communication interface a plurality of RFID tag reads for each participant, determining a time for each tag read, and determining a lapse time of each participant in the timed aquatic event as a function of the plurality of RFID tag reads.

The system also includes an RFID tag reader system having a processor, a memory, a clock, a communication interface for communicating with the event timing system and transmitting RFID tag reads as determined by the RFID tag read system to the even timing system. The RFID tag reader system has a radio frequency transceiver for generating a wireless communication with the RFID tag via an antenna. An aquatic antenna mounting assembly has an elongated body with an upper end and a lower end, and a middle portion positioned between the upper end and the lower end. An RFID antenna mounting assembly is attached proximate to the upper end of the elongated body configured for mounting an RFID antenna.

A stabilizer assembly is located at a fixed vertical position of the middle portion of the elongated body and includes a plurality of radially spaced apart coupling connectors. It also includes a plurality of anchors with each anchor having a mass significantly greater than water for placement on a bottom of an aquatic body and each having a coupling fixture. The assembly also includes a plurality of anchor lines with each anchor line having a first end for attachment to one of the coupling connectors of the stabilizer assembly and a second end for attachment to the coupling fixture of one of the anchors. One or more floatation devices is coupled to at least one of the elongated body and the stabilizer assembly and their sum of their buoyancy is selected to provide substantial floatation of the elongated body and the stabilizer assembly following mounting of an antenna to the RFID antenna mounting assembly.

The system also includes an aquatic antenna mounting assembly being positionable proximate to the aquatic timing point and an RFID antenna mounted on the RFID antenna mounting assembly. The RFID antenna is communicatively coupled to the radio frequency transceiver of the RFID tag reader system with the RFID tag reader system being configured for transmitting a tag read request from the antenna to the RFID tag and receiving at the antenna one or more tag reads from the RFID tag and also transmitting the tag read request and the tag reads between the RFID tag reader system and the antenna.

As described above, the RFID antenna mounting assembly can have two opposing sides for mounting a first RFID antenna on a first side and a second RFID antenna on a second side. The first RFID antenna is mounted to the first side of the RFID antenna mounting assembly and the second RFID antenna is mounted to a second side of the RFID antenna mounting assembly. The first antenna is configured for reading the RFID tag when it is in a direction of the first side and the second antenna is configured for reading the RFID tag when the RFID tag is in a direction of the second side. The radio frequency transceiver of the RFID tag reader is configured for communicating with each of the first and second RFID antenna and differentiating communications between the two antennas. In some embodiments, the system includes multiple aquatic antenna mounting assemblies, each having one or more RFID antenna mounted thereon and wherein each of the multiple aquatic antenna mounting assemblies are positioned spaced apart from one another at different aquatic timing points.

Figure 18:
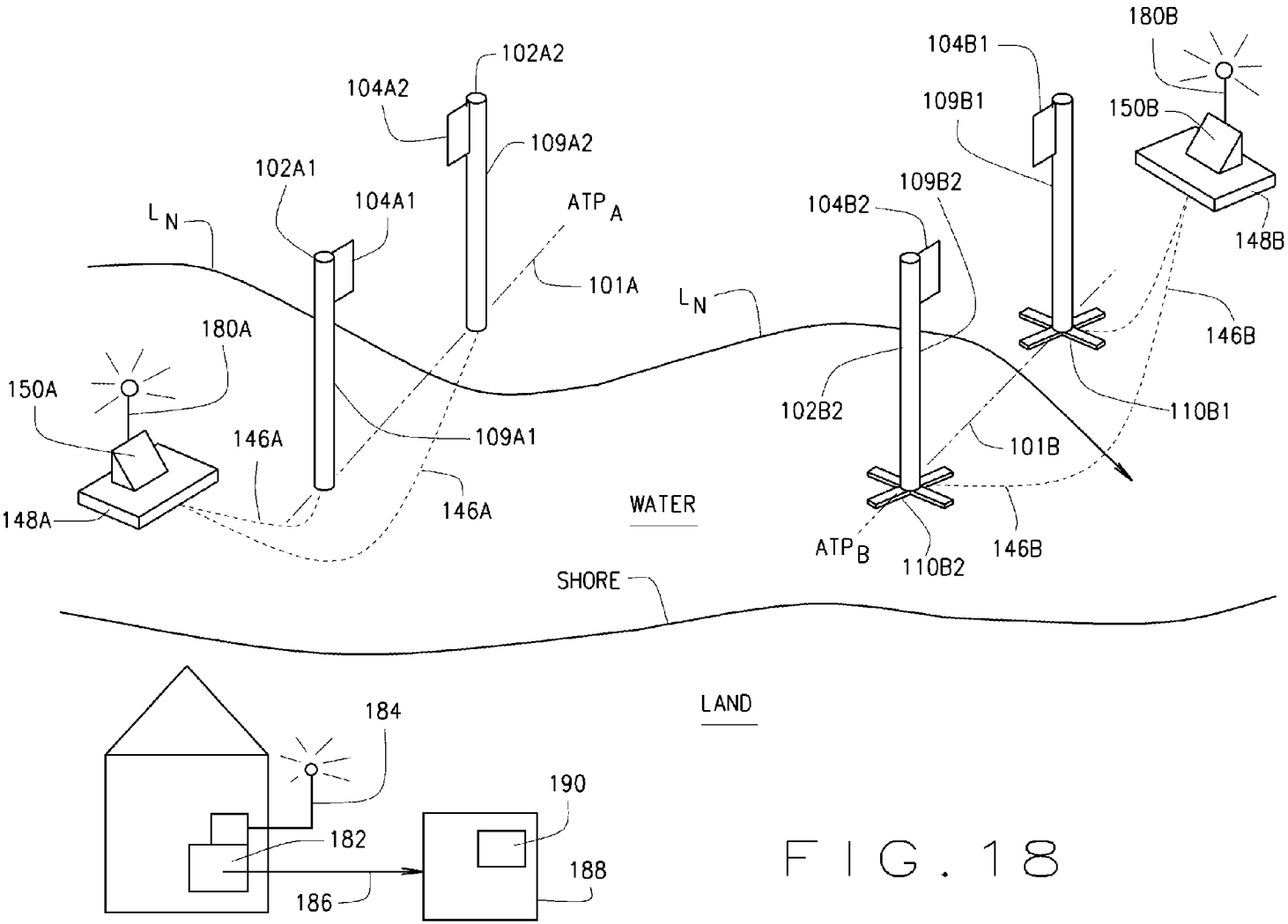
FIG. 18 is a side schematic view of an aquatic event timing system having a land based event timing system wirelessly coupled to two aquatic RFID tag reader systems, each of which has two aquatic RFID antennas mounted to aquatic RFID antenna mounting assemblies according to one exemplary embodiment of the invention.

An example of an aquatic timing system is illustrated in FIG. 18. As shown, an event timing system 182 can be positioned on land or in a water based vehicle, but here is shown in a building on land. The event timing system 182 includes a wireless transceiver 184 for communicating with the two aquatic RFID tag reader systems 150A and 150B that are located off shore on floating platforms 148A, 148B respectively. Each of the aquatic RFID tag reader systems 150A, 150B has a wireless transceiver and antenna 180A, 180B for wirelessly communication tag reads to the event timing system 182. Of course, a wired, cellular or satellite communication link between the event timing system 182 and each of the aquatic tag reader systems 150A, 150B is also possible and within the scope of the present disclosure. The event timing system 182 can also include a communication link to land based systems such as another timing system, an announcer system 188 or a display 190 for displaying or recording of tag events.

The first aquatic tag reader 150A is positioned in the water proximate to a first aquatic timing point 101A defined by two aquatic antenna 104A1 and 104A2, each of which are mounted on upwardly exposed ends of the elongated bodies 109A1 and 109A2 of aquatic antenna mounting assemblies 102A1 and 102A2, respectively. Each antenna 104A1 and 104A2 are coupled via a cable 146A to the tag reader 150A. At a spaced apart portion of the body of water, the second aquatic tag reader 150B is positioned in the water proximate to a second aquatic timing point 101B defined by two aquatic antenna 104B1 and 104B2, each of which are mounted on upwardly exposed ends of the elongated bodies 109B1 and 109B2 of aquatic antenna mounting assemblies 102B1 and 102B2, respectively. Each antenna 104B1 and 104B2 are coupled via a cable 146B to the tag reader 150B.

Figure 16:
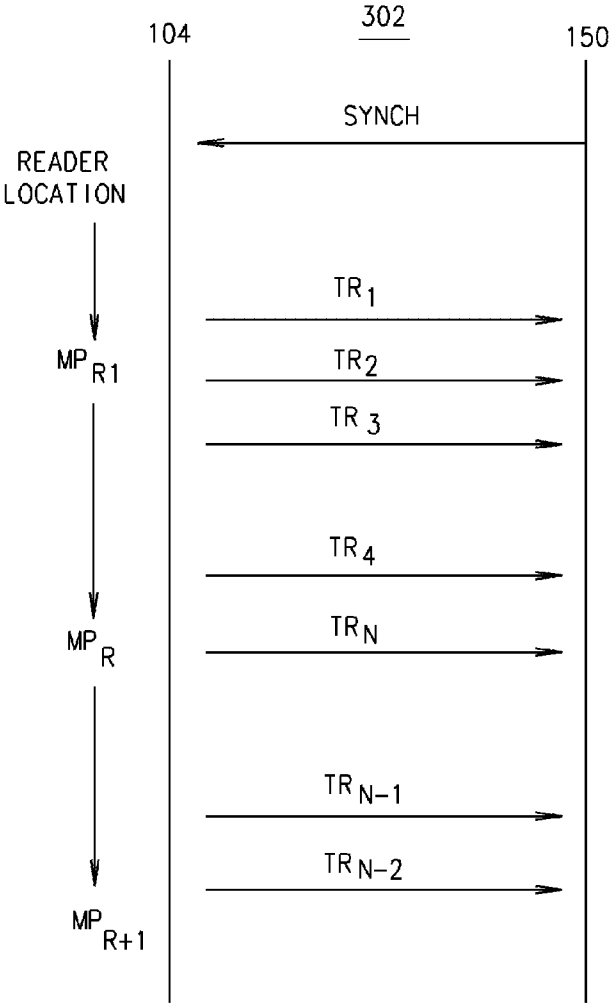
FIG. 16 is a timing diagram of a communication protocol between a timing system/module and three tag reader systems each of which is monitoring passing RFID tags at spaced apart monitored aquatic timing points according to one exemplary embodiment.

Referring back to FIG. 16, this is an illustration of another timing diagram 302 that is different than FIG. 15 in that the timing flow 302 is from different tag readers systems 150 with one or more antennas 104, each of the antennas 104 being located at spaced apart or offset distances from each other. In this illustration, when the participant P is at location of aquatic timing point 101, the antenna 104A obtains three tag reads $TR_{A1}$, $TR_{A2}$, and $TR_{A3}$ at monitored points $MP_{RN}$. The antenna 104 transmits each of these tag reads to the tag reader system 150 or a timing system 182 the later in packaged tag read messages. As the participant tag PT moves from a first position to a second position along course C more tag reads $TR_{B1}$, $TR_{B2}$ and $TR_{B3}$ are obtained. This process is continued as long as the participant tag PT is within RF range of the antenna 104.

Figure 17:
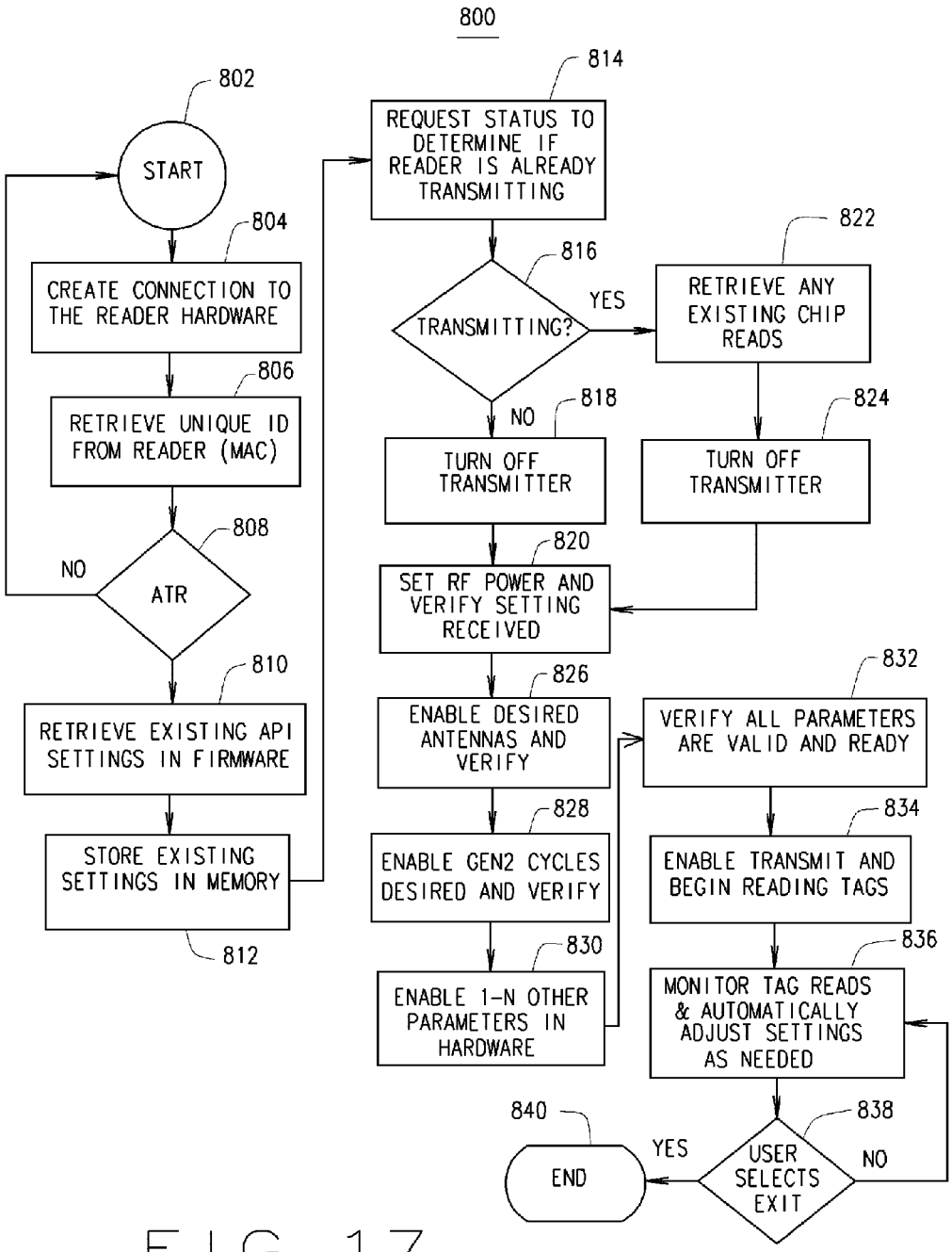
FIG. 17 is a flow chart of a remote tag reader instruction module for remotely providing instructions to an aquatic RFID tag reader system from an event timing system according to one exemplary embodiment.

FIG. 17 illustrates another method implemented by the aquatic tag reader system 150. As shown in process 800, the process 800 starts at process 802 and a connection is created to the aquatic tag reader system 150 system in process 804 and a unique ID is received back from the aquatic tag reader system 150 in process 806. This is typically a MAC address for the aquatic tag reader system 150. The timing system 182 reviews the received unique ID of process 806 and determines if the communicating system is a compatibly configured aquatic tag reader system 150 or a different system. As shown here, the aquatic tag reader system 150 is referred to as a Jaguar Cubby in process 808, but the aquatic tag reader system 150 can have other names. If the transmitting aquatic tag reader system 150 is not an aquatic tag reader system 150, the process returns to the start in process of 802. However, if the aquatic tag reader system 150 is a valid aquatic tag reader system 150, process 808 continues the processing flow to process 810 wherein the timing system 182 retrieves an existing API setting and continues the method in process 812 by storing the existing settings in memory.

Next in process 814, the timing system 182 transmits a request for the status to determine if the aquatic tag reader system 150 is already transmitting. If it is determined that the aquatic tag reader system 150 is not transmitting in process 816, the timing system 182 continues in process 818 to turn off the transmitter and setting the RF power and verifying the setting is received by the aquatic tag reader system 150. However, if the aquatic tag reader system 150 is already transmitting as determined by process 816, the timing system 182 retrieves any existing chip or tag reads in process 822 from the aquatic tag reader system 150 and then turns off the transmitter in process 824. The processes continue to process 820 wherein the system sets the RF power and verifies the settings are received in process 820. Next, the method continues to process 826 wherein the desired antennas are enabled and verified as to their enablement. Next in process 828 the GEN2 cycles that are desired are enabled and verified. In process 830 the 1-N other parameters in the hardware are also enabled and the method verifies all parameters are valid and ready in process 832. At that point, the method enables the transmission of tag reads and the aquatic tag reader system 150 begins to make tag reads in process 834. The timing system 182 then monitors the tag reads and automatically adjusts the settings during operation as desired or needed in process 836. At some point after operation has been running, the monitored event will be over and the user of the system can then select an exit in process 838 and the system processing functions and methods end at process 840.

TRS and ATS Operating Environment

Figure 19:
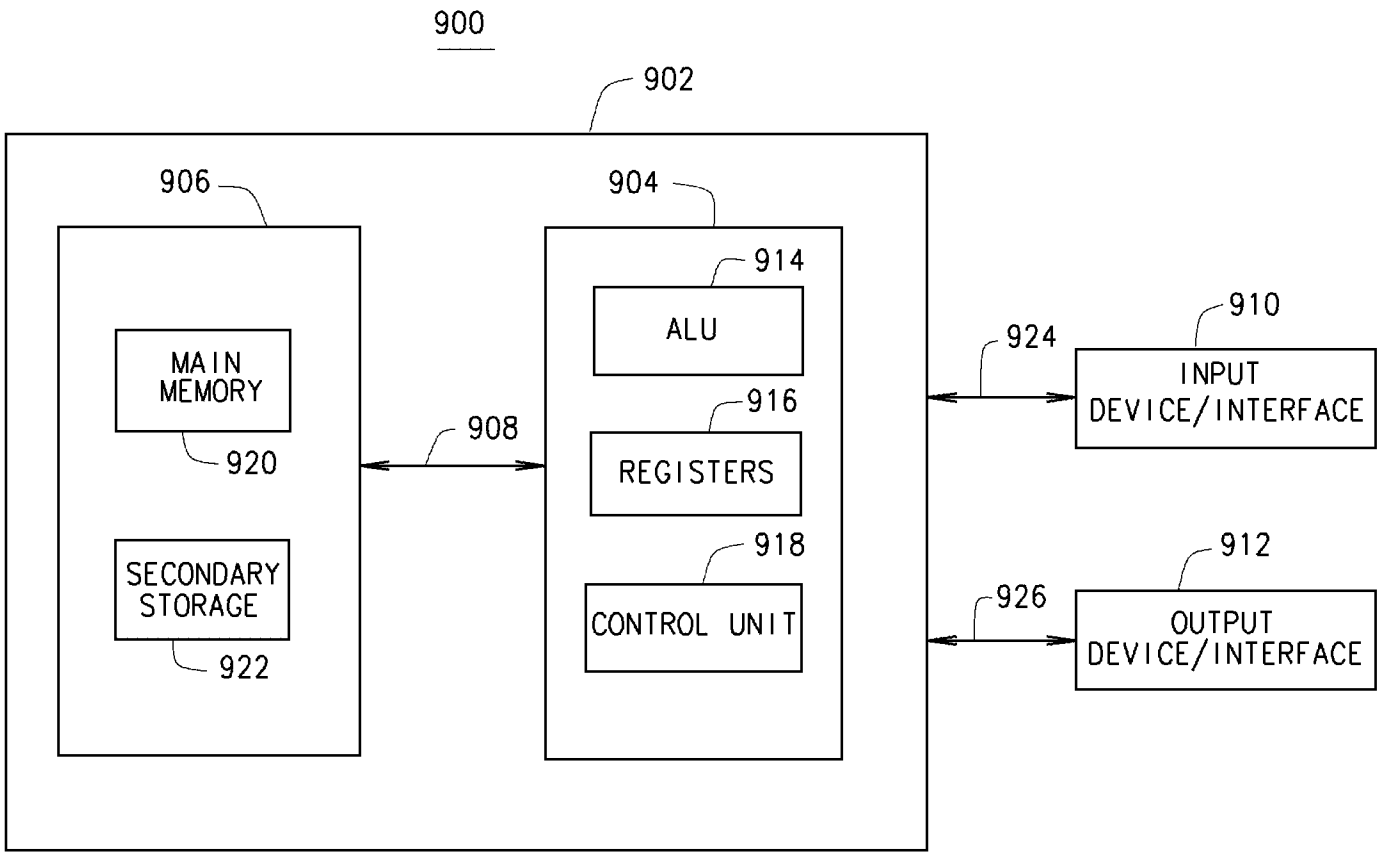
FIG. 19 is a block diagram of a specialized computer system suitable for implementing one or more aquatic RFID tag reader systems as described herein.

Referring to FIG. 19, an operating environment for an illustrated embodiment of one or more aquatic RFID tag reader systems 150 and/or timing systems 182 as described herein is a computer system 900 with a computer 902 that comprises at least one high speed central processing unit (CPU) 904, in conjunction with a memory system 906 interconnected with at least one bus structure 908, an input device 910, and an output device 912. These elements are interconnected by at least one aquatic safe bus structure 908. As addressed above, the input and output devices can include a communication interface including an antenna interface. Any or all of the components of the TRS and/or ATS systems can be any computing device including, but not limited to, a lap top, PDA, Cell/mobile phone, as well as potentially a dedicated device. The software can be implemented as any "app" thereon and still is within the scope of this disclosure.

The illustrated CPU 904 for an RFID semiconductor chip is of familiar design and includes an arithmetic logic unit (ALU) 914 for performing computations, a collection of registers for temporary storage of data and instructions, and a control unit 916 for controlling operation of the computer system 900. Any of a variety of processors, including at least those from Digital Equipment, Sun, MIPS, Motorola, NEC, Intel, Cyrix, AMD, HP, and Nexgen, is equally preferred but not limited thereto, for the CPU 904. This illustrated embodiment operates on an operating system designed to be portable to any of these processing platforms.

The memory system 906 generally includes high-speed main memory 920 in the form of a medium such as random access memory (RAM) and read only memory (ROM) semiconductor devices that are typical on an RFID semiconductor chip. However, the present disclosure is not limited thereto and can also include secondary storage 922 in the form of long term storage mediums such as floppy disks, hard disks, tape, CD-ROM, flash memory, etc., and other devices that store data using electrical, magnetic, and optical or other recording media. The main memory 920 also can include, in some embodiments, a video display memory for displaying images through a display device (not shown). Those skilled in the art will recognize that the memory system 906 can comprise a variety of alternative components having a variety of storage capacities.

Where applicable, while not typically provided on RFID tags or chips, an input device 910, and output device 912 can also be provided. The input device 910 can comprise any keyboard, mouse, physical transducer (e.g. a microphone), and can be interconnected to the computer 902 via an input interface 924 associated with the above described communication interface including the antenna interface for wireless communications. The output device 912 can include a display, a printer, a transducer (e.g. a speaker), etc., and be interconnected to the computer 902 via an output interface 926 that can include the above described communication interface including the antenna interface. Some devices, such as a network adapter or a modem, can be used as input and/or output devices.

As is familiar to those skilled in the art, the computer system 900 further includes an operating system and at least one application program. The operating system is the set of software or computer executable instructions that control the various computerized systems or components and their operation and allocation of resources. The application program is the set of software that performs a task desired by the user, using computer resources made available through the operating system. Both are typically resident in the illustrated memory system 906 that may be resident on the RFID semiconductor chip. These can include the tag reader system with computer implementable instructions stored in its memory that are accessible by and executable by the processor for performing one or more of the tag reader methods and means as described herein. Also, this can include the timing system with computer implementable instructions stored in its memory that are accessible by and executable by its processor for performing one or more of the timing system methods and means as described herein.

In accordance with the practices of persons skilled in the art of computer programming, the present disclosure is described below with reference to symbolic representations of operations that are performed by the computer system 900. Such operations are sometimes referred to as being computer-executed. It will be appreciated that the operations that are symbolically represented include the manipulation by the CPU 904 of electrical signals representing data bits and the maintenance of data bits at memory locations in the memory system 906, as well as other processing of signals. The memory locations where data bits are maintained are physical locations that have particular electrical, magnetic, or optical properties corresponding to the data bits. One or more embodiments can be implemented in tangible form in a program or programs defined by computer executable instructions that can be stored on a computer-readable medium. The computer-readable medium can be any of the devices, or a combination of the devices, described above in connection with the memory system 906.

Generally, the detection line located along a route traveled by the RFID tags is a starting line, a finish line or an intermediary check point line. As such, while the current disclosure is not limited to timing or tracking of timed racing events, in the exemplary embodiment as described herein, the timing system is configured for receiving each of the RFID tag read messages and determining a lapsed time of the RFID tag traversing between at least two of the starting line, the intermediary check point line and the finish line, responsive to at least one of the received RFID tag read messages.

As one skilled in the art will understand after reviewing the present disclosure, while the primary exemplary embodiment as described herein has been related to timing passings or elapsed time of a tag used in an aquatic racing or other timed event, other applications of timing activities using RFID tags is also possible and considered within the scope of the present disclosure.

When describing elements or features and/or embodiments thereof, the articles "a", "an", "the", and "said" are intended to mean that there are one or more of the elements or features. The terms "comprising", "including", and "having" are intended to be inclusive and mean that there may be additional elements or features beyond those specifically described.

Those skilled in the art will recognize that various changes can be made to the exemplary embodiments and implementations described above without departing from the scope of the disclosure. Accordingly, all matter contained in the above description or shown in the accompanying drawings should be interpreted as illustrative and not in a limiting sense.

It is further to be understood that the processes or steps described herein are not to be construed as necessarily requiring their performance in the particular order discussed or illustrated. It is also to be understood that additional or alternative processes or steps may be employed.

What is claimed is:

1. An assembly for use with an event timing system for determining a timing of passing of an aquatic timing point by a participant that includes a person, a boat, or water based vehicle participating in a timed aquatic event, the participant having an RFID tag with a unique participant identifier, the system comprising: an elongated body having an upper end and a lower end, and a middle portion positioned between the upper end and the lower end; an RFID antenna mounting assembly attached proximate to the upper end of the elongated body configured for mounting an RFID antenna; a stabilizer assembly located at a fixed vertical position of the middle portion of the elongated body, the stabilizer assembly including a plurality of radially spaced apart coupling connectors; a plurality of anchors, each anchor having a mass significantly greater than water for placement on a bottom of an aquatic body and a coupling fixture; a plurality of anchor lines, each anchor line having a first end for attachment to one of the coupling connectors of the stabilizer assembly and a second end for attachment to the coupling fixture of one of the anchors; and one or more floatation devices coupled to at least one of the elongated body and the stabilizer assembly, wherein the sum of the buoyancy of the one or more floatation devices selected to provide substantial floatation of the elongated body and the stabilizer assembly following mounting of an antenna to the RFID antenna mounting assembly.

2. The assembly of claim 1 wherein the elongated body is a PVC tube.

3. The assembly of claim 1 wherein the one or more floatation devices are coupled to the elongated body at the middle portion thereon.

4. The assembly of claim 1 wherein the stabilizer assembly includes a plurality of lateral members extending substantially perpendicular from the elongated body and wherein at least a portion of the coupling connectors are positioned proximate to a distal end of the lateral members.

5. The assembly of claim 4 wherein at least a portion of one or more floatation devices is positioned proximate to the distal ends of the lateral members.

6. The assembly of claim 5 wherein at least a portion of the one or more floatation devices is positioned on a lateral member proximate to the elongated body.

7. The assembly of claim 4 wherein the stabilizer assembly includes two elongated members having two opposing distal ends and a middle, each of the two elongated members attached to the elongated body about at the middle of each elongated member and positioned perpendicular to each other.

8. The assembly of claim 7 wherein the elongated body and the elongated members are each made of a PVC tube.

9. The assembly of claim 4 wherein the stabilizer assembly includes a plurality of supports, each support having a first end coupled to a spaced apart position of the elongated body and a second end coupled to one of the elongated members at a positioned spaced apart from the elongated body.

10. The assembly of claim 1 wherein each anchor line has at least one of the first end and the second end configured for adjusting a length of the anchor line and securing the adjusted length at a defined length position.

11. The assembly of claim 1, further comprising an RFID antenna mounted to the RFID antenna mounting assembly, the RFID antenna being communicatively coupled to an RFID tag reader system positioned remote from the assembly.

12. The assembly of claim 1 wherein the RFID antenna mounting assembly has two opposing sides for mounting a first RFID antenna on a first side and a second RFID antenna on a second side.

13. The assembly of claim 12, further comprising a first RFID antenna mounted to the first side of the RFID antenna mounting assembly and a second RFID antenna mounted to a second side of the RFID antenna mounting assembly, the first antenna configured for reading RFID tags in a direction of the first side and the second antenna configured for reading RFID tags in a direction of the second side.

14. The assembly of claim 1 wherein the sum of the buoyancy of the one or more floatation devices is greater than the weight of the elongated body, the stabilizer assembly and the mounted antenna.

15. A system for recording a passing of a participant that includes a person, a boat, a vehicle or any other water based device participating in a timed aquatic event past an aquatic timing point, the participant having an RFID tag with a unique participant identifier, the system comprising:

an RFID tag reader system having a processor, a memory, a clock, a communication interface, a radio frequency transceiver for generating a wireless communication with the RFID tag via an antenna;

an aquatic antenna mounting assembly having an elongated body having an upper end and a lower end, and a middle portion positioned between the upper end and the lower end, an RFID antenna mounting assembly attached proximate to the upper end of the elongated body configured for mounting an RFID antenna, a stabilizer assembly located at a fixed vertical position of the middle portion of the elongated body, the stabilizer assembly including a plurality of radially spaced apart coupling connectors, a plurality of anchors, each anchor having a mass significantly greater than water for placement on a bottom of an aquatic body and a coupling fixture, a plurality of anchor lines, each anchor line having a first end for attachment to one of the coupling connectors of the stabilizer assembly and a second end for attachment to the coupling fixture of one of the anchors, and one or more floatation devices coupled to at least one of the elongated body and the stabilizer assembly, wherein the sum of the buoyancy of the one or more floatation devices selected to provide substantial floatation of the elongated body and the stabilizer assembly following mounting of an antenna to the RFID antenna mounting assembly, the aquatic antenna mounting assembly being positionable proximate to the aquatic timing point; and an RFID antenna mounted on the RFID antenna mounting assembly and communicatively coupled to the radio frequency transceiver of the RFID tag reader system, wherein the RFID tag reader system is configured for transmitting a tag read request from the antenna to the RFID tag and receiving at the antenna one or more tag reads from the RFID tag, and transmitting the tag read request and the tag reads between the RFID tag reader system and the antenna.

16. The system of claim 15, further comprising a tag reader platform having a platform body with buoyancy and a plurality of platform anchors each attached to a spaced apart portion of the platform body by an anchor line.

17. The system of claim 15, further comprising a radio frequency communication cable coupling the RFID antenna to the radio frequency transceiver of the RFID tag reader system, wherein the aquatic antenna mounting system includes securing fixtures for securing the communication cable in a fixed position relative to the elongated body.

18. The system of claim 15 wherein the radio frequency communication cable includes a conduit defining an air tight cavity and an RF transmission line positioned within the air tight cavity.

19. The system of claim 18 wherein the conduit is a flexible conduit and the RF transmission line is a coax line.

20. The assembly of claim 15 wherein the RFID antenna mounting assembly has two opposing sides for mounting a first RFID antenna on a first side and a second RFID antenna on a second side, and wherein the antenna is a first RFID antenna mounted to the first side of the RFID antenna mounting assembly, further comprising a second RFID antenna mounted to a second side of the RFID antenna mounting assembly, the first antenna configured for reading the RFID tag when it is in a direction of the first side and the second antenna configured for reading the RFID tag when the RFID tag is in a direction of the second side, and wherein radio frequency transceiver of the RFID tag reader is configured for communicating with each of the first and second RFID antenna and differentiating communications between the two antenna.

21. A system for timing a plurality of participants including persons, boats, or water based vehicles participating in a timed aquatic event as they travel past at least one aquatic timing point, each participant having an RFID tag with a unique participant identifier, the system comprising: an event timing system having a processor for executing computer executable instructions, a memory for storing the computer executable instructions, and a communication interface, system configured for receiving over the communication interface a plurality of RFID tag reads for each participant, determining a time for each tag read, and determining a lapse time of each participant in the timed aquatic event as a function of the plurality of RFID tag reads; an RFID tag reader system having a processor, a memory, a clock, a communication interface for communicating with the event timing system and transmitting RFID tag reads as determined by the RFID tag read system to the event timing system, a radio frequency transceiver for generating a wireless communication with the RFID tag via an antenna; an aquatic antenna mounting assembly having an elongated body having an upper end and a lower end, and a middle portion positioned between the upper end and the lower end, an RFID antenna mounting assembly attached proximate to the upper end of the elongated body configured for mounting an RFID antenna, a stabilizer assembly located at a fixed vertical position of the middle portion of the elongated body, the stabilizer assembly including a plurality of radially spaced apart coupling connectors, a plurality of anchors, each anchor having a mass significantly greater than water for placement on a bottom of an aquatic body and a coupling fixture, a plurality of anchor lines, each anchor line having a first end for attachment to one of the coupling connectors of the stabilizer assembly and a second end for attachment to the coupling fixture of one of the anchors, and one or more floatation devices coupled to at least one of the elongated body and the stabilizer assembly, wherein the sum of the buoyancy of the one or more floatation devices selected to provide substantial floatation of the elongated body and the stabilizer assembly following mounting of an antenna to the RFID antenna mounting assembly, the aquatic antenna mounting assembly being positionable proximate to the aquatic timing point; and an RFID antenna mounted on the RFID antenna mounting assembly and communicatively coupled to the radio frequency transceiver of the RFID tag reader system, wherein the RFID tag reader system is configured for transmitting a tag read request from the antenna to the RFID tag and receiving at the antenna one or more tag reads from the RFID tag, and transmitting the tag read request and the tag reads between the RFID tag reader system and the antenna.

22. The system of claim 21 wherein there are multiple RFID antennas mounted to the aquatic antenna mounting assembly.

23. The assembly of claim 22 wherein the RFID antenna mounting assembly has two opposing sides for mounting a first RFID antenna on a first side and a second RFID antenna on a second side, and wherein the antenna is a first RFID antenna mounted to the first side of the RFID antenna mounting assembly, further comprising a second RFID antenna mounted to a second side of the RFID antenna mounting assembly, the first antenna configured for reading the RFID tag when it is in a direction of the first side and the second antenna configured for reading the RFID tag when the RFID tag is in a direction of the second side, and wherein radio frequency transceiver of the RFID tag reader is configured for communicating with each of the first and second RFID antenna and differentiating communications between the two antenna.

24. The system of claim 22 wherein there are multiple aquatic antenna mounting assemblies, each having one or more RFID antenna mounted thereon, and wherein each of the multiple aquatic antenna mounting assemblies are positioned spaced apart from one another at different aquatic timing points.

25. The system of claim 24, further comprising at least one tag reader platform associated with at least one of the RFID tag reader systems, each tag reader platform having a platform body with buoyancy and a plurality of platform anchors each attached to a spaced apart portion of the platform body by an anchor line.

* * * * *